US011173488B2

(12) United States Patent
Savran et al.

(10) Patent No.: US 11,173,488 B2
(45) Date of Patent: Nov. 16, 2021

(54) HIGH-THROUGHPUT PARTICLE CAPTURE AND ANALYSIS

(71) Applicant: Purdue Research Foundation, West Lafayette, IN (US)

(72) Inventors: Cagri A. Savran, West Lafayette, IN (US); Chun-Li Chang, West Lafayette, IN (US); Wanfeng Huang, San Jose, CA (US); Onur Gur, West Lafayette, IN (US); Rohil Jain, West Lafayette, IN (US)

(73) Assignee: Purdue Research Foundation, West Lafayette, IN (US)

( * ) Notice: Subject to any disclaimer, the term of this patent is extended or adjusted under 35 U.S.C. 154(b) by 290 days.

(21) Appl. No.: 16/095,648

(22) PCT Filed: Apr. 24, 2017

(86) PCT No.: PCT/US2017/029202

§ 371 (c)(1),
(2) Date: Oct. 22, 2018

(87) PCT Pub. No.: WO2017/185098

PCT Pub. Date: Oct. 26, 2017

(65) Prior Publication Data

US 2019/0143328 A1 May 16, 2019

Related U.S. Application Data

(60) Provisional application No. 62/326,405, filed on Apr. 22, 2016.

(51) Int. Cl.
*B01L 3/00* (2006.01)
*B03C 1/01* (2006.01)
(Continued)

(52) U.S. Cl.
CPC ..... *B01L 3/502761* (2013.01); *B03C 1/01* (2013.01); *B03C 1/0332* (2013.01);
(Continued)

(58) Field of Classification Search
CPC ..... B01L 3/502761; B01L 2200/0652; B01L 2200/0668; B01L 2200/06673; B01L 3/02;
(Continued)

(56) References Cited

U.S. PATENT DOCUMENTS

2002/0001855 A1* 1/2002 Prentiss ..... G01N 33/54326 436/526
2008/0160622 A1* 7/2008 Su ..... G01N 35/08 436/86
(Continued)

FOREIGN PATENT DOCUMENTS

CN 103392124 11/2013
JP 2015-125032 7/2015
(Continued)

OTHER PUBLICATIONS

CN Office Action in Chinese Appln. No. 201780037898.1, dated Feb. 10, 2021, 10 pages (with English translation).
(Continued)

*Primary Examiner* — Brian J. Sines
(74) *Attorney, Agent, or Firm* — Fish & Richardson P.C.

(57) ABSTRACT

Microfluidic systems and methods are described for capturing magnetic target entities bound to one or more magnetic beads. The systems include a well array device that includes a substrate with a surface that has a plurality of wells arranged in one or more arrays on the surface. A first array of wells is arranged adjacent to a first location on the surface. A second and subsequent arrays, if present, are arranged sequentially on the surface at second and subsequent loca-
(Continued)

tions. When a liquid sample is added onto the substrate and caused to flow, the liquid sample will flow across the first array first and then flow across the second and subsequent arrays in sequential order. The wells in the first array each have a size that permits entry of only one target entity into the well and each well in the first array has approximately the same size.

26 Claims, 17 Drawing Sheets

(51) Int. Cl.
*B03C 1/033* (2006.01)
*B03C 1/28* (2006.01)

(52) U.S. Cl.
CPC ..... *B03C 1/0335* (2013.01); *B03C 1/288* (2013.01); *B01L 2200/0652* (2013.01); *B01L 2200/0668* (2013.01); *B01L 2200/0673* (2013.01); *B01L 2200/0689* (2013.01); *B01L 2300/0627* (2013.01); *B01L 2300/0803* (2013.01); *B01L 2300/0819* (2013.01); *B01L 2300/0851* (2013.01); *B01L 2400/043* (2013.01); *B01L 2400/0487* (2013.01); *B01L 2400/086* (2013.01); *B03C 2201/18* (2013.01); *B03C 2201/26* (2013.01)

(58) Field of Classification Search
CPC ..... B03C 1/01; B03C 1/0332; B03C 1/0335; G01N 1/18; G01N 27/745
See application file for complete search history.

(56) References Cited

U.S. PATENT DOCUMENTS

2008/0160634 A1* 7/2008 Su ..... B03C 1/288 436/501
2009/0093374 A1 4/2009 Suh et al.
2011/0104747 A1 5/2011 Pollack et al.
2011/0198294 A1 8/2011 Sharpe
2012/0129208 A1 5/2012 Khine et al.
2012/0196774 A1* 8/2012 Fournier ..... B01L 3/502761 506/32
2014/0057289 A1 2/2014 Savran et al.
2014/0242614 A1 8/2014 Chieng-Teng et al.
2016/0003859 A1 1/2016 Wenczel et al.
2016/0130640 A1* 5/2016 Wright ..... B01F 7/00141 506/39
2017/0175102 A1* 6/2017 Chiou ..... C12N 15/895
2019/0049434 A1* 2/2019 Blainey ..... G01N 33/543

FOREIGN PATENT DOCUMENTS

WO WO 2014/011146 2/2004
WO WO 2004/035776 4/2004
WO WO 2012/072822 6/2012
WO WO 2014/017116 1/2014
WO WO 2015/095395 6/2015

OTHER PUBLICATIONS

CN Office Action in Chinese Appln. No. 201780037898.1, dated Apr. 14, 2020, 23 pages (with English translation).
EP Extended European Search Report in European Appln. No. 17786808.0, dated Feb. 28, 2019, 12 pages.
EP Office Action in European Appln. No. 17786808.0, dated Jan. 7, 2020, 5 pages.
Khan et al., "Fabrication of polymeric biomaterials: a strategy for tissue engineering and medical devices," Journal of Materials Chemistry B, Aug. 21, 2015, 3(42):8224-49.
PCT International Search Report and Written Opinion in International Appln. No. PCT/US2017/029202, dated Jul. 20, 2017, 11 pages.
JP Japanese Office Action in Japanese Appln. No. 2018-555231, dated Jun. 1, 2021, 13 pages (with English translation).

* cited by examiner

HIGH-THROUGHPUT PARTICLE CAPTURE AND ANALYSIS

CROSS-REFERENCE TO RELATED APPLICATIONS

This application is a 371 U.S. National Phase Application of PCT/US2017/029202, filed on Apr. 24, 2017, which claims priority to U.S. Provisional Application No. 62/326,405, filed on Apr. 22, 2016 and entitled "HIGH-THROUGHPUT PARTICLE CAPTURE AND ANALYSIS," the entire disclosure of which is incorporated herein by reference.

FIELD

This specification generally relates to microfluidic systems.

BACKGROUND

Individual particles, such as cells, within a fluid sample can be difficult to analyze within high-throughput microfluidic systems when large number of cells are included in the sample. In addition, individual cells must initially be isolated from the fluid sample to properly analyze cellular contents such as DNA, RNA, and/or proteins, depending on the type of test performed. In some instances, individual cells can also need to be isolated in pre-defined geometric arrangements to enable automated processing and analysis. Common isolation techniques often include diluting a fluid sample in a manner such that only a single cell can coincide with a single micro-well of a micro-well-plate. However, such techniques lack sufficient accuracy and speed, and primarily rely upon statistics, reducing the chances of obtaining repeatable results.

Although high-throughput microfluidic systems have been proposed to overcome challenges associated with single cell analysis, such systems still have various limitations. For instance, while various geometric arrangements of micro-wells can be used to increase capture of individual cells, these techniques are often incapable of capturing both individual cells and cell clusters within a single fluid sample. In addition, designs of such systems are often incapable of capturing rare cells with relatively low concentrations in a fluid. Another limitation impacting the use of these systems is that they are often unable to allow access to captured cells, preventing the ability to directly manipulate captured cells without risk of reducing cell viability.

SUMMARY

The systems and techniques described herein can be used in many scientific and clinical studies of disease conditions where analyzing individual cells separately is critical to understand and detect cell-to-cell variations. For instance, the systems and techniques can be used to improve studies of cancers that have tumor heterogeneity, which can often require identifying the presence and nature of multiple tumors. As an example, if multiple cells are combined and lysed, then their genetic contents will mix and information pertaining to cell-to-cell variations will be compromised and/or lost. However, if they can be isolated, captured, and analyzed separately using the systems and techniques described herein, information relating to cell-to-cell variations can be retained for analysis. This applies to cells obtained from fluids (e.g. blood, urine, and saliva) and also cells obtained by grinding solid tissues, e.g., tumor tissue, chemically or mechanically.

Accordingly, the innovative aspects described throughout this disclosure include devices, systems, and methods that are capable of capturing individual particles, e.g., cells, cell clusters, and/or other types of particles, generally "target entities," within a fluid sample that is flowed across or introduced onto a micro-well array device (also referred to herein as a "micro-well chip"), e.g., arranged in, or as a part of, a microfluidic chamber. The micro-well chip includes a substrate, e.g., a thin plate, having a surface with one or more arrays of micro-wells in which the micro-wells have a size selected to enable a particular size of target entity to enter the micro-wells. In one implementation, all of the micro-wells are in one array and all have approximately the same size, e.g., within plus or minus five percent of a selected size. In other implementations the micro-well chip can have two or more arrays of micro-wells in which the micro-wells in a given array are all approximately the same size, but the micro-wells in one array have a different size from the micro-wells in another array.

As used herein, the term "size," when referring to a micro-well, can be any one or more of a diameter, cross-sectional area, depth, shape, and/or total volume of the micro-well.

For example, a micro-well chip can have two arrays of micro-wells in which a first array of smaller micro-wells is located on the surface of the substrate near a first location, e.g., a first end, of the surface, e.g., closer to an inlet port of a microfluidic chamber, to capture individual target entities, e.g., cells, and in which a second array that includes relatively larger micro-wells is located on the surface closer to a second location, e.g., a second end (e.g., "downstream" of the first array) and closer to an outlet port of a microfluidic chamber, to capture larger cells or cell clusters that do not fit into the upstream smaller micro-wells.

The systems can also include a magnet component that can be used to apply a flow-independent variable magnetic force to direct and control the movement of target entities that are magnetic or made to be magnetic. For example, the magnet component is used to move target entities into the micro-wells and/or to hold the target entities in the micro-wells, without a need to use a wash step to avoid false-positive detection of non-specific target entities, e.g., cells, which can often lead to unintended loss of specific target entities.

As used herein, the term "magnetic" when referring to target entities means either inherently magnetic, paramagnetic, or superparamagnetic, or made to be magnetic, paramagnetic, or superparamagnetic, by the application of a magnetic or electric force. The term magnetic when referring to target entities also refers to target entities that are, or are made to be, magnetic, paramagnetic, or superparamagnetic by being attached, i.e., linked, to a bead or particle that is itself magnetic, paramagnetic, or superparamagnetic.

In different implementations, the magnitude of the magnetic force is modulated to increase or decrease the target entity, e.g., cell, settling rate, and the direction of the applied magnetic field can be adjusted to cause magnetically induced target entity movement along one or two dimensions of the surface of the micro-well chip. In this regard, the micro-well arrangement of the plate and the application of the variable magnetic field can be used to more efficiently capture magnetized cells and cell clusters with higher accuracy and consistency.

In one implementation, target entities and particles (e.g., smaller and larger cells or cell clusters) in a sample fluid initially encounter a first array with smaller micro-wells before encountering one or more additional arrays with larger micro-wells. For example, smaller target entities can enter into the micro-wells of the first array, but larger target entities cannot, because they are too large to pass into the openings of micro-wells in the first array. During a typical capture operation using this implementation, a magnet is moved or swept, e.g., horizontally, beneath the micro-well chip to direct the larger target entities that have not been captured across the surface of the micro-well chip towards the second array with larger micro-wells. In some implementations, the remaining target entities that are too large to be situated in the micro-wells of the second array are then directed toward the micro-wells of a third array by moving the magnet downstream in a similar manner. To achieve this, target entities can be flowed into the chamber while the magnet is substantially underneath the first array, so as to place all target entities on the first array. The flow can then be stopped or reduced significantly to prevent smaller entities from accidentally reaching the larger micro-wells of subsequent arrays. Once small target entities are captured in the micro-wells of the first array, flow can be restarted or increased to assist the magnet in moving the remaining larger target entities into the next array with larger wells downstream, and so on.

The target entities, e.g., cells, can be inherently magnetic, paramagnetic, or superparamagnetic, or can be made magnetic, paramagnetic, or superparamagnetic by attaching to the target entity one or more beads or particles that are themselves magnetic, paramagnetic, or superparamagnetic. Thus, the combined complex of target entity and beads or particles is then magnetic, paramagnetic, or superparamagnetic, and can be manipulated with a magnet arranged adjacent to the micro-well chip, e.g., below, on the sides, or above the micro-well chip, as described in further detail herein.

In a first general aspect, the disclosure features a micro-well array device for capturing target entities that are, or are made to be, magnetic. The first micro-well array device includes a substrate including a surface comprising a plurality of micro-wells arranged in one or more arrays on the surface where a first array of micro-wells is arranged at a first location on the surface. Second and subsequent arrays, if present, are arranged sequentially on the surface at second and subsequent locations, where when a liquid sample is added onto the substrate and caused to flow, the liquid sample will flow across the first array first and then flow across the second and subsequent arrays in sequential order. The micro-wells in the first array each have a size that permits entry of only one target entity into the micro-well and wherein each micro-well in the first array has approximately the same size. The micro-wells in the second and subsequent arrays, if present, each have a size that is at least 10 percent larger than the size of the micro-wells in the previously adjacent array and wherein each micro-well in a given subsequent array has approximately the same size. The plurality of micro-wells all have a size sufficient such that after target entities enter the micro-wells, at least one target entity remains within a micro-well when fluid flows across the surface or when a magnetic force is applied to the target entities in the micro-wells or both fluid flows and a magnetic force is applied.

In certain implementations, the micro-well array device includes a magnet component arranged adjacent to the surface. The magnet component is arranged and configured to generate a magnetic force sufficient to attract the target entities into the one or more arrays of micro-wells after target entities enter the micro-wells and to hold at least one target entity in at least one of the micro-wells when fluid flows across the surface.

In some implementations, the magnet component is adjustably arranged adjacent to the surface. In such implementations, the magnet component is arranged and configured to generate a magnetic force sufficient to hold at least one target entity in at least one of the micro-wells when the magnet is moved, e.g., horizontally, adjacent the surface.

In some implementations, the substrate is a polygon, e.g., a rectangle, having first and second ends. In such implementations, the first array of micro-wells is arranged at a first end of the substrate, and second and subsequent arrays are arranged further away from the first end of the substrate than the previously adjacent array.

In some implementations, the substrate is radially symmetric, e.g., circular or octagonal, and the first array of micro-wells includes one or more concentric circles of micro-wells arranged around a central location of the substrate that is devoid of micro-wells. The substrate includes second and subsequent arrays each including one or more concentric circles of micro-wells arranged further away from the central location of the substrate than the previously adjacent array.

In a second general aspect, the disclosure features a microfluidic system for capturing target entities that are, or are made to be, magnetic. The microfluidic system includes a body including a chamber having an inlet, an outlet, and is configured to contain the micro-well array device described above. The microfluidic system also includes a magnet component adjustably arranged adjacent to the surface. The magnet component is arranged and configured to generate a magnetic force sufficient to move target entities sized to fit into the micro-wells in the first array along, e.g., horizontally on, the surface and into the micro-wells in the first array and to move larger target entities along, e.g., horizontally on, the surface and into second and subsequent arrays. The magnetic force is sufficient such that after target entities enter the micro-wells, at least one target entity remains within a micro-well when fluid flows across the surface or when a magnetic force is applied to the target entities, or both fluid flows and the magnetic force is applied.

In some implementations, the microfluidic system further includes a detector configured to analyze optical properties of the target entities.

In some implementations, the magnet component is configured to be moved along at least one, e.g., two, axes, e.g., horizontal axes, relative to the surface.

In some implementations, a portion of the body, e.g., a transparent portion, above the chamber is detachable from the body of the microfluidic system, e.g., to allow access to the micro-well array device once target entities have been captured and retained.

In some implementations, the micro-well array device is an integral part of the body and the surface of the micro-well array device forms one wall, e.g., a floor, of the chamber. Alternatively, the micro-well array device can be in the form of a separate micro-chip that can be inserted into and/or removed from the microfluidic chamber.

In certain implementations, the microfluidic system includes a pump for flowing the fluid from the inlet of the chamber to the outlet of the chamber at a flow rate sufficient to permit target entities to reach the micro-well arrays.

In certain implementations, the microfluidic system includes a target entity extraction module configured to extract target entities from at least one of the plurality of micro-wells. In such implementations, the microfluidic system includes a second magnet component adjustably arranged relative to the target entity extraction module opposite the plurality of micro-wells. The second magnet component is configured to generate a variable magnetic force sufficient to attract a target entity that is, or is made to be, magnetic from a micro-well into an entrance channel of the target entity extraction module.

In some implementations, the target entity extraction module includes a micropipette, and the second magnet component includes a magnetic ring placed on a tip of the micropipette.

In some implementations, the surface includes a base layer, and a micro-well array device in the form of a micro-well array layer arranged on top of and contacting the base layer. The micro-well array layer includes a plurality of through holes that form the plurality of micro-wells. Alternatively, the micro-well array layer can simply be the micro-well array device with micro-wells that are not through holes, and is arranged to form one wall of the chamber.

In some implementations, the base layer or the micro-wells in one or more of the arrays are functionalized with one or more binding moieties to enhance binding of the target entities to the base layer or to inner walls of the micro-wells.

In some implementations, the micro-wells in the second array each have a size that permits entry of a second target entity into the micro-well. In such implementations, the second target entities are larger than the first target entities, and micro-wells in the first array each have a size that does not permit entry of the second target entity into the micro-well.

In some implementations, the size of the micro-well is any one or more of diameter, cross-sectional area, depth, shape, and total volume.

In some implementations, the size of the micro-wells that is varied between arrays is a diameter, volume, or cross-sectional area, while a depth of the plurality of micro-wells is approximately the same in all arrays.

In some implementations, the microfluidic system includes a set of magnetic beads comprising on their surfaces one or more binding moieties that specifically bind to a molecule on the surface of the target entities.

In a third general aspect, the disclosure features a method of capturing target entities. The method includes adding a fluid sample containing magnetic target entities into a chamber of the microfluidic system of the micro-well array device described above. The method also includes applying, using the magnet component adjustably arranged underneath the surface, a variable magnetic force to the chamber, and adjusting the position of the magnet component relative to the surface such that the applied variable magnetic force attracts the target entities into the first and/or second array of micro-wells. In certain implementations, the method includes analyzing, using a detector component, a property of the target entities.

In some implementations, the property to be analyzed includes quantity, size, sequence and/or conformation of molecules, DNA, RNA, proteins, small molecules, and enzymes contained inside the target entities, or molecular markers contained on surfaces of target entities, or molecules secreted from target entities.

In certain implementations, after adjusting the position of the magnet component relative to the surface, the method includes detaching a lid of the body of the microfluidic system, and extracting a target entity from at least one of the plurality of micro-wells.

In some implementations, extracting the target entity from at least one of the plurality of micro-wells includes transporting the extracted target entity to a container outside the microfluidic system.

In some implementations, analyzing includes detecting fluorescence emitted by the target entities. In some implementations, adjusting the position of the magnet component includes moving the magnet component along one, two, or three axes, e.g., horizontal axes, relative to the surface. In some implementations, after adjusting the placement of the magnet component relative to the surface, the method further includes providing a turbulent flow into the microfluidic device, and extracting a magnetized target entity from at least one of the plurality of micro-wells. In some implementation, adjusting the placement of the magnet component relative to the surface includes moving the magnet component in a pattern that causes the target entities to follow the pattern along the surface. In some implementations, adding the fluid sample containing magnetic target entities into the chamber includes flowing the fluid sample from the inlet to the outlet over the surface comprising the plurality of micro-wells.

In some implementations, adding the fluid sample containing magnetic target entities into the chamber includes dispensing the fluid sample onto the surface of the chamber comprising the plurality of micro-wells. In some implementations, the variable magnetic force is applied to the chamber while the fluid sample is being placed into the chamber of the microfluidic chamber.

In a fourth general aspect, the disclosure features a micro-well array device for capturing target entities that are, or are made to be, magnetic. The micro-well array device includes a substrate including a surface comprising a plurality of micro-wells arranged in one or more arrays on the surface. A first array of micro-wells is arranged adjacent to a first end of the surface, and a second array, if present, is arranged further away from the first end of the surface than the first array and any additional arrays are arranged sequentially such that each subsequent array is arranged further away from the first end of the surface than a neighboring array. The micro-wells in the first array each have a size that permits entry of only one target entity into the micro-well and wherein each micro-well in the first array has approximately the same size. The micro-wells in the second array, if present, each have a size that is at least 10 percent larger than the size of the micro-wells in the first array. The plurality of micro-wells all have a depth sufficient such that after target entities enter the micro-wells, at least one target entity remains within a micro-well when fluid flows across the surface.

In some implementations, the substrate includes a plurality of micro-wells arranged in two or more arrays on the surface. In certain implementations, substrate includes a plurality of micro-wells arranged in one array on the surface. In some implementations, the size is a diameter, volume, cross-sectional area.

In a fifth general aspect, the disclosure features a microfluidic system for capturing target entities that are, or are made to be magnetic. The microfluidic system includes a body including a chamber having an inlet, an outlet, and a surface extending from the inlet to the outlet. The surface includes a plurality of micro-wells that all have a depth that is at least 1 times the size of the smallest target entity that, after target entities enter the micro-wells, at least one target entity remains within a micro-well when fluid flows through the chamber. The microfluidic system also includes a magnet component adjustably arranged adjacent to the surface, wherein the magnet component is arranged and configured to generate a magnetic force sufficient to attract the target entities into the array of micro-wells that after target entities enter the micro-wells, at least one target entity remains within the micro-wells when the magnet is moved, e.g., horizontally.

In certain implementations, the microfluidic system includes a detector configured to analyze optical properties of the target entities. In some implementations, the magnet component is configured to be moved along one or two exes, e.g., horizontal axes, relative to the surface. In some implementations, the depth of the plurality of micro-wells allows the target entities to be carried out of the plurality of micro-wells by a turbulent flow of liquid in the chamber. In some implementations, the plurality of micro-wells are sufficiently spaced apart such that a target entity in a first micro-well adjacent to a second micro-well remains within the first micro-well when a suction force by a pipette is applied nearby the second micro-well.

In some implementations, a portion of the body above the chamber is detachable from the body of the microfluidic system such that at least a portion of the plurality of micro-wells is accessible by a tip of a micropipette once the portion of the body has been detached The various micro-well array devices described throughout can include a substrate that includes only one, two, three, four, five, six, ten, or even many more arrays, e.g., arrays in the form of columns or concentric circles of micro-wells. The micro-well array devices can be simply inserted into a chamber, e.g., a glass or plastic or other chamber, container, or cuvette, and then the sample fluid is applied to the surface, either as a droplet that spreads across the device or a flow of the sample across the surface from one end to the other. The magnet component can be used to direct the target entities by moving the magnet component underneath the device until most or all of the target entities have entered a micro-well. Thereafter, the magnet component can be secured to or sufficiently near the bottom of the device to ensure that the target entities remain in the micro-wells while other assay steps are performed on the micro-well assay device, e.g., washing steps, labeling steps, incubation steps, or analysis steps. Alternatively, this can be achieved by using one or multiple electromagnets arranged in the vicinity of the cell array. In such implementations, the electromagnets can be stationary and their magnetic fields can be controlled and/or turned on or off. By turning the electromagnets on and off in sequence, a "moving" magnetic force can be created to cause the motion of the magnetized target entities, (e.g., particles or cells) without having to move the magnets physically.

The micro-well array devices can be used, e.g., to separately capture and isolate individual cells and clusters of cells on the same device, or to separately capture and isolate different sized cells on the same device.

The micro-well array devices (micro-well chips) as well as the microfluidic cell analysis systems described herein allow for increased capture efficiencies of target entities of varying sizes based on the magnitude of the magnetic force applied, the dimensions of the micro-wells placed on the surface of the micro-well chip, and the flow rate of the liquid flowing over the micro-well chip, e.g., through a microfluidic chamber that encloses the surface of a micro-well chip. The micro-well chips can be used to capture both individual cells, e.g., cells of different sizes, as well as cell clusters that can be present within a fluid sample, because the arrays of micro-wells placed on the surface of the micro-well chip vary by size (e.g., diameter, cross-sectional area, depth, shape, and/or total volume) from one array to another. In addition, the magnetic force can be applied in a manner that is independent of the rate of flow and volume of fluid flowing through the microfluidic chamber and independent of gravity such that cell settling is not necessary to capture cells within the micro-wells of the micro-well chip. This removes the need for a wash step after sample injection into the microfluidic chamber, which reduces the likelihood of losing target cells and improves testing speed.

As described herein, "target entities" or "target particles" within a fluid sample are either inherently magnetic, paramagnetic, or superparamagnetic, or are magnetized (e.g. made magnetic, paramagnetic, or superparamagnetic), at least temporarily, using different techniques, e.g., as described herein. The target entities or particles can be cells (e.g., human or animal blood cells, mammalian cells (e.g., human or animal fetal cells, e.g., in a maternal blood sample, human or animal tumor cells, e.g., circulating tumor cells (CTC), epithelial cells, stems cells, B-cells, T-cells, dendritic cells, granulocytes, innate lymphoid cells, senescent cells (and other cells that are related to idiopathic pulmonary fibrosis), megakaryocytes, monocytes/macrophages, myeloid-derived suppressor cells, natural killer cells, platelets, red blood cells, thymocytes, neural cells) bacterial cells (e.g., *Streptococcus pneumonia, E. coli, Salmonella, Listeria*, and other bacteria such as those that lead to sepsis including methicillin-resistant *Staphylococcus aureus* (MRSA)).

The target entities or particles can also be plant cells (e.g., cells of pollen grains, leaves, flowers and vegetables, parenchyma cells, collenchyma cells, xylem cells and plant epidermal cells) or various biomolecules (e.g., DNA, RNA, or peptides), proteins (e.g., antigens and antibodies), or contaminants in environmental (e.g., sewage, *Burkholderia pseudomallei, Cryptosporidium parvum, giardia lamblia* and parasitic worms) or industrial samples (e.g., detergents, disinfection by-products, insecticides, herbicides, volatile organic compounds, petroleum and its byproducts, solvent including chlorinated solvents and drugs). The target entities that are cells can have a minimum diameter between one hundred nanometers to one micron and range up to about 20, 30, or 40 microns or more. The clusters of target entities can be larger and range up to 100 μm or 1 mm in size (e.g., 250, 500, or 750 μm). Although this disclosure in described in reference to the capture of cells or cell clusters, the systems and methods described herein can also be to capture or isolate other types of target entities or particles from liquid samples. For example, the target entities can be exosomes or other extracellular vesicles with sizes that can be as small as 30 nanometers or less.

Unless otherwise defined, all technical and scientific terms used herein have the same meaning as commonly understood by one of ordinary skill in the art to which this invention belongs. Although methods and materials similar or equivalent to those described herein can be used in the practice or testing of the present invention, suitable methods and materials are described below. All publications, patent applications, patents, and other references mentioned herein are incorporated by reference in their entirety. In case of conflict, the present specification, including definitions, will control. In addition, the materials, methods, and examples are illustrative only and not intended to be limiting.

The details of one or more implementations are set forth in the accompanying drawings and the description below.

Other potential features and advantages will become apparent from the description, the drawings, and the claims.

BRIEF DESCRIPTION OF THE DRAWINGS

FIGS. 3C-1 and 3C-2 are cross-sectional diagrams that illustrate an example of a micro-well chip with a detachable portion.

FIG. 3D is a schematic diagram that illustrates an example of a system with a micro-well chip that has a removable polymer film to enable access to micro-wells.

In the drawings, like reference numbers represent corresponding parts throughout.

DETAILED DESCRIPTION

Figure 1A:
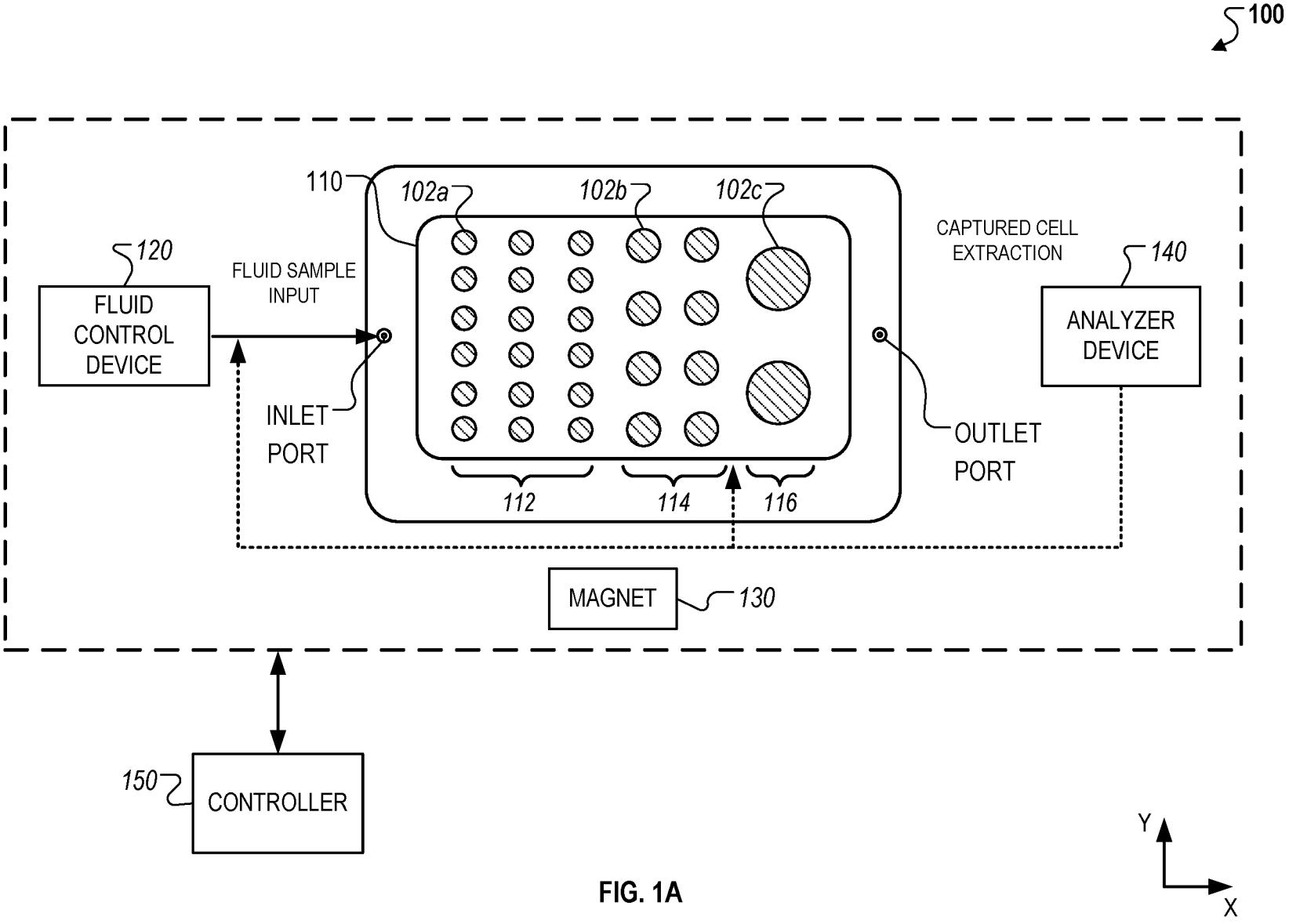
FIG. 1A is a schematic diagram that illustrates a top view of an example of a cell analysis system.

In general, this disclosure describes cell analysis systems and methods that are capable of capturing and isolating both individual particles, such as cells, e.g., cells of different sizes, and clusters of particles, such as cell clusters, suspended in a fluid sample flowing across a micro-well chip, e.g., through a microfluidic chamber that encloses a micro-well chip, or in which a micro-well patterned surface is formed into the bottom wall. The bottom surface of the chamber includes a portion of the floor or a separate micro-well chip that has a micro-well arrangement, e.g., a single array of micro-wells in which all of the micro-wells are approximately the same size, or two or more arrays, e.g., in which arrays of smaller micro-wells are located closer to an inlet port of the microfluidic chamber to capture individual cells, e.g., smaller cells, and arrays with larger micro-wells are located further from the inlet port (and closer to an outlet port) to capture larger cells or cell clusters. The micro-wells can be arranged in multiple arrays, e.g., wherein the micro-wells in each array are the same size or approximately the same size (e.g., all of the micro-wells within one array have a size, e.g., diameter, or cross-sectional area, or depth, or shape, and/or total volume, that is plus or minus 5% of the selected size for the micro-wells in the array), but the size (e.g., diameter, or cross-sectional area, or depth, or shape, and/or total volume) of the micro-wells in different arrays are different from the size in the first array (e.g., by at least 10, 20, 30, 40, or 50 percent, e.g., by at least 75, 100, 125, 150, 200, 500, 750, or even 1000 percent). For example, the wells in a third array can be larger than those in the second array by the same percentages. Similarly, the wells of each array can be larger than those in the preceding array by the same percentages as above.

Even though for some applications it may be sufficient to keep the depths of all wells in all arrays the same, and only change their diameter, it may also be necessary to increase the depths of wells in subsequent arrays as well as their diameters to account for entities and clusters that are larger in up to 3 dimensions. In one implementation, the area occupied by each array may be similar or equal. In other implementations, the areas occupied by arrays may be different from each other (e.g. by 25, 50 or 100%). For example, the first array may occupy 50% to 75% of the entire area covered by all arrays. This implementation may help ensure that in the presence of fluid flow across the micro-well chip surface, all target entities first land on the first array and help minimize the possibility of small target entities reaching other arrays downstream.

In some implementations, the micro-wells can be arranged in columnar arrays, in which the micro-wells are arranged in columns (e.g., each array is a column of micro-wells) perpendicular to a central axis of the micro-well chip from one end to another, e.g., from the inlet to the outlet of a microfluidic chamber if the micro-well chip is arranged within, or is a part of, a chamber. The micro-wells in the column closest to the inlet can have the smallest size, e.g., diameter, cross-sectional area, depth, shape, and/or total volume, and the micro-wells in the column closest to the outlet have the largest size, e.g., diameter. In all implementations, the depth of all of the micro-wells in one, some, or all arrays (e.g., columns) can be the same or different, but each micro-well must be sufficiently deep to enclose and "trap" a cell or cluster of cells and keep the cells in the micro-wells even when liquid is flowing over the top of the micro-well or when the magnet is moved, e.g., horizontally, to lead target entities into the subsequent wells.

In some implementations, the diameters and depths of all micro-wells in one column are the same or approximately the same. Other than instances in which the extraction of the target entities from the micro-wells is intended, it is generally desirable that once target entities are captured in micro-wells, all of them remain in the micro-wells even under the influence of fluid flow and/or a motion, e.g., a horizontal motion, of the magnet. In some implementations it may be necessary to keep 100% of the target entities (e.g. cells) in the micro-wells, while in other implementations it may be sufficient to keep 90%, 80%, 50% or as low as 10%, or even just 1% of the target entities or a single target entity in the micro-wells, even if the rest are unintentionally extracted from the micro-wells.

In certain implementations, the depth of a micro-well can be limited to prevent unintended stacking of multiple cells on top of each other. In these implementations, the micro-well depth could be slightly larger than the nominal diameter of a cell to help prevent the stacking of a second cell. Alternatively, the micro-well depth can be slightly smaller than the nominal diameter of the cell as long as the cell is still prevented or inhibited from moving out of the micro-well prematurely. In this implementation, a part of the cell can protrude above the surface surrounding the micro-well. Alternatively, this implementation can also take advantage of the flexibility of the cells, which under the application of a vertical downward force will compress in the vertical direction, ultimately making a cell's height smaller than its nominal diameter. In this case, a cell can remain entirely inside the micro-well.

In one implementation, a second micro-well chip with the same micro-well diameters, but greater depths, can be placed on top of the micro-well chip 110 in a manner that aligns the entrances of all of the micro-wells, so that an external magnetic force can extract the cells from the micro-wells of micro-well chip 110 and move them into the micro-wells of the secondary chip. This implementation will effectively change the depth of the micro-well in which a cell is located.

In some implementations, the second micro-well chip can have micro-wells that have different diameters than those of the first micro-well chip.

The systems are also capable of applying a flow-independent variable attractive force to direct movement of magnetic, paramagnetic, or superparamagnetic cells of interest without a need to use a wash step to avoid false-positive detection of non-specific cells. For instance, the magnitude of the applied flow-independent attractive force can be manipulated to increase or decrease the cell-settling rate, and the direction of the applied magnetic field can be adjusted to cause magnetically induced cell movement along two dimensions of the plate surface. In this regard, the micro-well arrangement on the plate and the application of the variable magnetic field can be used to efficiently capture cells and cell clusters with high accuracy and consistency.

System Overview

FIG. 1A illustrates an example of a cell analysis system 100 that generally includes a fluid control device 120 used to supply a fluid sample with magnetic or magnetized cells to be analyzed, a micro-well chip 110 used to capture the magnetic or magnetized cells suspended in the fluid sample, a magnet 130 generally situated underneath the chip, used to generate an attractive force to attract the magnetic or magnetized cells, and an analyzer device 140 used to detect characteristics associated with the cells.

The "magnetic beads" as described herein for use in the systems and methods described herein can be magnetic, paramagnetic, or superparamagnetic particles that can have any shape, and are not limited to spherical shapes. Such magnetic beads are commercially available or can be specifically designed for use in the methods and systems described herein. For example, Dynabeads® are magnetic or superparamagnetic and come in various diameters (1.05 μm, 2.8 μm and 4.5 μm). Sigma provides paramagnetic beads (1 μm, 3 μm, 5 μm, and 10 μm). Pierce provides superparamagnetic beads, e.g., 1 μm. Thermo Scientific MagnaBind® Beads are superparamagnetic and come in various diameters (1 μm to 4 μm). Bangs Lab sells magnetic and paramagnetic beads (0.36, 0.4, 0.78, 0.8, 0.87, 0.88, 0.9, 2.9, 3.28, 5.8, and 7.9 μm). R&D Systems MagCellect® Ferrofluid contains superparamagnetic nanoparticles (150 nanometers in diameter). Bioclone sells magnetic beads (1 μm and 5 μm). In addition, PerkinElmer provides (Chemagen) superparamagnetic beads (e.g., 0.5-1 μm and 1-3 μm). The magnetic beads are particles that can range in size, for example, from 10 nanometers to 100 micrometers, e.g., 50, 100, 250, 500, or 750 nanometers or 1, 5, 10, 25, 50, or 75 micrometers.

If a cell is traveling in a fluidic chamber under the influence of a substantially horizontal fluidic flow and a downward magnetic force, its contact with the surface depends on a balance between the fluidic drag force and the downward magnetic force which depends on the magnetic field, as well as the properties and the number of the beads on the cell surface. The fluidic drag force depends on the average flow velocity, which is related as represented by the following equation: $Q=V*A$, where Q is the flow rate, V is the average fluid velocity, and A is the cross-sectional area of the flow chamber.

Investigators have demonstrated that when a tumor cell, e.g., a circulating tumor cell (CTC), is bound to at least 7 superparamagnetic beads (with 1 μm average diameter, e.g., from Sigma), the cell has a 90% probability in encountering a solid surface if the average fluid velocity is on the order of 4.4 mm/s (i.e., 2 ml/min flow rate with a cross-sectional area of about 7.6 $mm^2$). See, *Lab chip,* 2015, 15, 1677-1688. In the study, the magnet used was a neodymium permanent magnet (K&J Magnetics, grade N52) with 0.4 to 1.5 T of flux density and a gradient of 160 to 320 T/m in the vicinity of the surface of the magnet, which was placed some 650 micrometers below the surface of a chip. Under these conditions, even a cell that has a single magnetic bead can be attracted to the chip surface, albeit with a lower probability.

In some implementations, the flow rates and velocities can be reduced significantly in order to maximize the probability of capturing cells. Higher flow rates (ml/min) can result in higher velocities (mm/s) which may introduce risk of cells escaping the surface. Alternatively, higher flow rates can still be used with larger cross-sectional areas so as to prevent the average velocity from increasing. In these implementations, "cross-sectional area" refers to that of the fluidic chamber that is perpendicular to the fluid flow. Alternatively, stronger magnets or beads with higher magnetic susceptibility (e.g. higher iron-oxide content) can also be used. In some other variations, higher affinity antibodies can be coupled on the beads surface. This will result in greater number of beads binding to the surface of a cell, and hence a greater overall magnetic force.

In some implementations, the fluidic flow rate and speed can also be increased without causing cells captured in the micro-wells to escape from the surface of the micro-well chip. For example, in one implementation, the volumetric flow rate and the cross-sectional area are configured to enable average flow velocities that range from 0.01 mm/s to 50 mm/s, e.g., 0.1, 0.5, 1.0, 2.5, 5.0, 7.5, 10.0, 12.5, 15, 20, 25, 30, 35, 40, or 45 mm/s.

Most magnetic beads typically have an iron oxide core in their center with a polymeric shell. The beads can also come pre-coated with a surface that can be easily functionalized, e.g., a surface coating of streptavidin, biotin, dextran, carboxyl, NHS, or amines.

In various implementations, magnetic beads are bound or linked to specific antigens expressed on the surfaces of the target cells within the fluid sample. In these implementations, the magnetic beads are functionalized in any one or more ways, e.g., new, conventional, or commercially available, ways to include one or more binding moieties or one or more different types of binding moieties, e.g., appropriate monoclonal or polyclonal antibodies including, but not limited to, antibodies against EpCAM, EGFR, Vimentin, HER2, progesterone receptor, estrogen receptor, PSMA, CEA, folate receptor, or with other binding moieties such as aptamers, or short peptides that can bind to specific target entities.

In specific examples or functionalization techniques, low molecular weight ligands (e.g. 2-[3-(1,3-dicarboxy propyl)-ureido] pentanedioic acid ("DUPA") for prostate cancer cells, and folic acid for ovarian cancer cells or other cancer cells that over-express the folate receptor on their surfaces including lung, colon, renal and breast cancers) are used to promote binding to certain cells. Specifically, low molecular weight ligands (e.g., DUPA and folate) can be bound to a functional group (amino, n-hydroxy succinamide (NHS), or biotin depending on the functional group on the magnetic bead to be used) with a linker group, e.g., with a polyethylene glycol (PEG) chain, in between the low molecular weight ligand and the functional group to suppress nonspecific binding to the beads.

In other instances, magnetic particles are internalized by the target cells by exposing the fluid sample to droplets of magnetic particles, fluid flow of the magnetic particles, or with the use of a magnetophoretic flow to the micro-well chip. For example, the target cells can be incubated in a fluid that contains the magnetic, paramagnetic or superparamagnetic particles, typically nanoparticles having a size of about 1 nm to a micrometer, under conditions and for a time sufficient for the cells to internalize the magnetic particles. In one implementation, the size of the magnetic particles is several micrometers as long as the particles are sufficiently smaller than the size of the cells so that that they can be internalized by the cells. In one implementation, the cells are blood cells or tumor cells with sizes that range from 5 micrometers to 20 micrometers.

The micro-well chip 110 can include multiple surfaces that form a microfluidic chamber where the fluid sample flows between an inlet port and an outlet port. The bottom surface of the microfluidic chamber either includes or contains a plate that includes an array of micro-wells (also referred to herein as "wells") that is designed to capture individual cells or cell clusters that are suspended in the fluid sample. The dimensions of the micro-wells (e.g., diameter, depth, shape, etc.) and the micro-well array pattern can be varied based on the target entity, e.g., target cell, to be captured using the micro-well chip 110. In some instances, the micro-well chip 110 can also include an arrangement with multiple arrays of micro-wells in which all the micro-wells in each array (or group of arrays) have the same dimensions, but the dimensions of the micro-wells in different arrays (or groups of arrays) are different to simultaneously capture individual cells and cell clusters within a single sample run through the chamber.

In an alternative implementation, the micro-well chip 110 functions without a fluidic chamber or any inlet and outlet ports or a fluid control device. In this implementation, the sample fluid containing magnetized cells are exposed to the top surface of the micro-well chip 110 in the form of a droplet, using conventional methods such as pipetting. For example, a cuvette type fluidic chamber (with an open top) can be configured to accommodate the micro-well chip 110. This cuvette can be accessed directly from above directly by pipettes or inlet and outlet tubing. Alternatively, the cuvette can also be configured to have a fluidic inlet and a fluidic outlet.

The fluid control device 120 can be any type of fluid delivery device used to introduce a sample fluid into a fluidic circuit. For instance, the fluid control device 120 can be either a peristaltic pump, a syringe pump, a pressure controller with a flow meter, or a pressure controller with a matrix valve. The fluid control device 120 can be configured to tubing that attaches to the inlet port of the micro-well chip 110 to introduce the sample fluid into the microfluidic chamber of the micro-well chip 110. In some instances, the fluid control device 120 is also capable of adjusting the flow rate of the sample fluid introduced into the microfluidic chamber according to a predetermined program. This predetermined program can be based on a specific sequence that involves flowing the sample fluid that contains cells for a certain period of time at certain speeds and then introducing certain dyes to stain the cells and certain molecules and enzymes to bind to or interact with the cells.

The fluid control device 120 can be placed in different locations of a fluidic circuit associated with the micro-well chip 110. In some implementations, the fluid control device 120 is located upstream of the micro-well chip 110 (e.g., before the inlet port of the micro-well chip 110 within the fluidic circuit). In such implementations, the fluid control device 120 can be used to exert a force that "pushes" a volume of fluid from a sample chamber (e.g., a cuvette) into a chamber containing the micro-well chip 110. In other implementations, the fluid control device 120 can be located downstream of the micro-well chip 110 (e.g., after the outlet port of the micro-well chip 110 within the fluidic circuit). In such implementations, the fluid control device 120 can instead be used to exert a force, e.g., a suction force that "pulls" fluid from the sample container into the chamber containing the micro-well chip 110. The flow rate used by the fluid control device 120 in either the downstream or the upstream configuration can range between, for example, 0-100 mL/minute, or 0.1-3 mL/minute, e.g., 10, 20, 30, 40, 50, 60, 70, 80, or 90 mL/minute, or 0.25, 0.5, 0.75, 1.0, 1.5, 2.0, 2.5, or 3.0 mL/minute.

The magnet 130 is generally situated underneath the chip 100 and is calibrated relative to the magnetic beads linked to the target entities to exert a magnetic force sufficient to pull the target entities towards the entrances of the micro-wells in the surface of the micro-well chip 110, and to retain the target entities within the micro-wells once the target entities have passed through the entrances of the micro-wells. The magnetic force is also sufficiently strong to pull the target entities out of the fluid flow through the microfluidic chamber that tends to pull the target entities in a flow path parallel to the surface of the micro-well chip 110. As an example, the magnet 130 can be an NdFeB Cube Magnet (about 5×5×5 mm) with a measured surface flux density and computed gradient of 0.4 T to 2 T and 100 to 400 T/m (depending on the exact location of the measurement), respectively. In other examples, other magnets including, but not limited to, larger or smaller permanent magnets made of various materials, and electromagnets that are commercially available or manufactured using standard or microfabrication procedures and that are capable of generating time-varying magnetic fields, can also be used. The magnetic flux density and the gradients can range from 0.01 to 10 T/m, 10 to 100 T/m, 100 to 100 T/m, and 1 to 1000 T/m, respectively.

The magnet 130 can have different shapes and dimensions based on a particular application. For example, the shape of the magnet 130 can be, but is not limited to, a cubic shape, rectangular prism-like shape, a ring shape, a circular or elliptical shape, or a combination thereof. In addition, multiple magnets can be used. The size of the magnet 130 can vary such that its minimum dimension can be between 0.1-30 cm. In some implementations, the magnet 130 is a ring-shaped magnet that is used to cause and/or help dispersing of aggregates of magnetic particles or magnetized target entities. For example, a ring-shaped magnet can be placed around an aggregate of target entities to help dispersing of individual target entities towards a perimeter of the magnet 130.

The magnet 130 can be housed within a cavity formed in the bottom half of a housing that includes the micro-well chip 110 or can be attached to an outer surface of the housing without the need for a cavity. The magnet 130 can be affixed to or supported relative to the outside of the micro-well chip 110 provided that it is oriented or positioned in a manner to attract the target entities toward the surface of the micro-well chip 110, and to adjust the movement of cells on the surface of the chamber in a controlled manner. For instance, the magnet 130 can be used to guide cells on the surface along a path defined by the movement of the magnet 130 underneath the micro-well chip 110. In other implementations, the magnet or magnets can be secured within a receiving chamber in a system into which a microfluidic device as described herein, e.g., in the form of a cartridge or cuvette, can be inserted. Such systems can also include the required pumps, controllers (e.g., computers or microprocessors), fluid conduits, reservoirs for fluids to be passed through the microfluidic devices, and analysis systems and equipment as described herein.

Movement of the magnet 130 can be accomplished manually, by a motor, and/or can be provided with a controller that allows selection of a particular sweep pattern for the magnet. The magnet 130 can be electromagnets that can be activated or deactivated as desired. Moreover, the electromagnets can be configured to reverse polarities as part of a technique for controlling movement of the magnetic beads and ligand-bound entities. In addition, the orientation of the magnet 130 can be changed to selectively control the magnitude and direction of the attractive force applied.

In some implementations, multiple magnets, e.g., electromagnets, can be used and controlled, for example, in tandem or in sequence, to generate magnetic fields that vary with respect to time and space. For example, two or more electromagnets situated in the vicinity (e.g. below) the micro-well chip 110 can be controlled to generate a moving magnetic force that is used to move magnetic entities along the surface of the micro-well chip 110.

The magnitude of the attractive force applied by the magnet 130 can be adjusted based on the magnetic properties of the particles attached to the cells, the strength of the magnet 130, and/or the placement of the magnet 130 relative to the micro-well chip 110. For example, the magnet 130 can be associated with an external body so that the distance of the magnet from the micro-well chip 110 can be varied to thereby vary the magnetic force applied to the target entities in the microfluidic chamber. The magnetic force applied can then be calibrated to a particular type of target entity or a particular type of functionalized magnetic beads used. In addition, the magnet 130 can be moved to remove the magnetic force entirely according to a protocol for the system 100. Removal of the magnetic force can be used to facilitate removal of the captured target entities within the micro-wells so that the target entities can then be transported or flushed to a separate collection vessel. In one implementation, the magnet 130, or another magnet, can be placed on top of the chip to help extract the cells out of the micro-wells. The magnet 130 that is placed on the top can then be moved sideways for sequential extraction of cells in micro-well arrays.

In some implementations, the magnet 130 includes an array of electromagnets placed underneath the micro-well chip 110 in a manner that covers a portion of the micro-well chip 110. One or more electromagnets within the array can then be selectively powered in certain sequences to apply attractive forces to cause motion of the cells along specified pathways along the surface of the micro-well chip 110.

The analyzer device 140 can be configured to use optical techniques to analyze the cells that are captured within the micro-wells of the chamber surface. For instance, the analyzer device 140 can be configured to use various microscopic techniques based on fluorescence, bright field, dark field, Nomarski, mass spectroscopy, Raman spectroscopy, surface plasmon resonance, among other known techniques.

The analyzer device 140 can include a CCD camera and a computerized image acquisition and analysis system. The CCD camera can be large enough to cover the size of the entire area of the micro-well chip 110 in a manner to acquire images from all micro-wells in the micro-well chip 110. Alternatively, the CCD camera can be able to analyze a smaller field of view that contains only one micro-well or a group of micro-wells. In such implementations, the CCD camera or the chip 100 can be moved manually or using a translation stage or other computer controlled modalities to sequentially align the CCD camera with other micro-wells and acquire their images.

The analyzer device 140 can be used to analyze various aspects cell capture process using the micro-well chip 110. For example, the analyzer device 140 can be used to analyze cells that have been extracted from micro-wells of the micro-well chip 110. Alternatively, the analyzer device 140 can additionally or alternatively be used to visualize and/or confirm cell capture within micro-wells of the micro-well chip 110 prior to cell extraction.

The cell analysis system 100 can optionally include a controller 150. The controller 150 can be used to automate actions performed on the micro-well chip 110 for various steps of the methods described herein, e.g., sample fluid injection, cell capture, extraction of captured cells, and/or analysis of captured cells. In one example, the controller 150 can be used to adjust the position of a translation stage that adjusts the position of the micro-well chip 110 relative to the field-of-view of the analyzer device 140 to record images of the contents of each micro-well or relative to a micro-pipette for extraction of captured cells. In another example, the controller 150 is capable of generating computer-implemented instructions that adjust the location of the magnet 130 and the magnitude of the generated attracted force to customize the cell capture technique for a specific type of sample fluid.

The controller 150 can be a microprocessor configured to follow a controlled flow protocol to a particular target entity, recognition element, and sample size. The controller 150 can incorporate a reader to read indicia associated with a particular sample or samples, and automatically upload and execute a predetermined flow protocol associated with the particular sample. The controller 150 can also modulate the magnetic field during a detection cycle to facilitate capturing the target entities and drawing the unbound magnetic beads into the array of micro-wells.

The controller 150 can also be configured to allow user-controlled operation. For instance, the flow rate for a particular target cell-magnetic bead combination can be determined by increasing the flow rate of a bound target cell sample until it is no longer possible to attract beads to the surface of the micro-well chip 110. The continuous operation of the system 100 can be directly observed through a visualization window to determine whether a flow bypass is required or whether the detection process is complete. The controller 150 can also cause the micro-well chip 110 to move to enable the analyzer device 140 to scan and obtain images on various sections of the micro-well chip 110. These images can then be used to reconstruct an image of the entire or a part of the surface of the micro-well chip 110.

Micro-Well Arrangement

FIG. 1A illustrates an example of arrays of micro-wells within a micro-well chip 110. As depicted, the micro-well chip 110 includes three separate arrays of micro-wells 112, 114, and 116, wherein the micro-wells in each array all have the same, or approximately the same, size, e.g., diameter, cross-sectional area, depth, shape, and/or total volume, but the size, e.g., diameters, of micro-wells in different arrays are different. For instance, micro-well 102*a* in micro-well array 112 can be used to capture individual cells or the smallest target entities, micro-well 102*b* in micro-well array 114 is somewhat larger in diameter and can be used to capture small cell clusters or larger single cells, and micro-well 102*c* in micro-well array 116 has the largest diameter and can be used to capture large cell clusters or even larger single cells. In other implementations, the micro-well chip can have only one array in which all of the micro-wells have approximately the same size.

The size of the entrance of the micro-wells 102*a*, 102*b*, and 102*c* on the surface of the micro-well chip 110 can be configured such that either only a single cell or a cell cluster is captured within the micro-well. The micro-wells 102*a*, 102*b*, and 102*c* also have a sufficient depth such that once a single cell or cell cluster is captured within the micro-wells, the captured cells remain within the micro-wells even as the fluid sample continues to flow through the microfluidic chamber from the inlet port to the outlet port, or in the absence of the attractive force applied by the magnet 130.

In one implementation, the depth of each micro-well is limited to prevent stacking of multiple cells. The depth of a micro-well can be between the nominal diameter of a targeted cell and less than 2 times the nominal diameter of a targeted cell. As an example, a circulating tumor cell's diameter is about 15 micrometers. The depth of the micro-well can be between 15 and 30 micrometers. As another example, the size of a bacterium is about 1 micrometer and the depth of a micro-well can be between 1 and 2 micrometers. In another embodiment, the depth of the micro-well can be equal to or even 5, 10, 20 or 50% less than the nominal diameter of a cell given the possibility that once a cell is inside the micro-well and under the influence of a downward magnetic force, its thickness can reduce, while its width can increase. For these cases, the depth of the micro-well can be configured so that when a first cell is already in the micro-well, another second cell that coincides on top of the first cell has a part of it exposed outside the micro-well, so that it can be washed away by flow or a sideways magnetic force while the first cell will be prevented from being washed away. For the example of a 15-micrometer circulating tumor cell (CTC), the depth of the micro-well can be between 1 micrometer and 15 micrometers. It should be appreciated that the depth of the micro-wells need to be configured depending on the nominal size of the target cell or the cell cluster sought to be captured/isolated and hence specific depths of micro-wells in micrometers in an actual device can be different from those that are mentioned here. In addition, in some implementations, the depths of micro-wells are fabricated to differ from array to array or within the same array.

In one implementation, the magnetic force as well as the spacing between the micro-wells is adjusted to minimize the possibility of magnetized entities aggregating and hence the possibility of multiple magnetic entities entering into the same micro-well.

In one implementation, the dimensions of the micro-wells are configured such that captured cells can be released from the micro-wells upon the application of a turbulent flow through the microfluidic chamber. For example, the flow rate of the sample fluid, the micro-well depth, and the magnitude of the attractive force applied by the magnet 130 can be carefully selected and controlled such that the cells that are captured in the micro-wells can be extracted in a controlled manner by either adjusting the attractive force applied or the fluidic flow rate of the sample fluid. In some implementations, an individual cell, or a cell cluster, is retrieved by means of a pipette, either manually or in a computer-controlled fashion, in the presence or absence of fluid flow.

As an example, if the cells to be captured in the micro-well chip 110 are white blood cells with 10-20 micrometer diameters, the entrance of the micro-well 102*a* on the surface of the micro-well chip 110 can be 15-30 micrometers. Alternatively, in other instances, the size of the entrance can be equal to or 5 to 20% smaller than the cell diameter so that the cell is squeezed into the micro-well by the attractive force applied by the magnet 130. As another example, the captured cells can be circulating tumor cells with 10-20 micrometer diameters and the entrance of the micro-well 102*a* on the surface of the micro-well chip 110 can be 10-35 micrometers. As another example, the captured cells can be red blood cells with 6-8 micrometer diameters. In this case, the entrance of the micro-well 102 on the surface of the micro-well chip 110 can be 6 to 10 micrometers. As another example, the captured cells can be bacteria with an approximately 1-micrometer diameter and the entrance of the micro-well 102*a* on the surface of the micro-well chip 110 can be 1 to 2 micrometers. Yet as another example, the captured cells can be exosomes with diameters ranging from 50 to 100 nanometers, and the entrance of the well 102*a* on the surface of the micro-well chip 110 can be larger than 50 nm.

In the example depicted in FIG. 1A, micro-wells with larger-sized entrances, such as the array of micro-wells 116, are placed downstream from the inlet port within the microfluidic chamber relative to micro-wells with smaller sized entrances such as the array of micro-wells 112. In such a micro-well arrangement, the magnet 130 underneath the micro-well chip 110 can be moved from one side, e.g., the left side, of the micro-well chip 110 to another side, e.g., the right side, of the micro-well chip such that smaller individual cells (or smallest target entities) are initially captured in the array of micro-wells 112, whereas larger cells and smaller and larger cell clusters proceed downstream along the pathway of the magnet 130, because they are too large to fit through the entrances of the array of micro-wells 112.

In some implementations, the bottoms of the micro-wells include one or more micro-pores or openings that are capable of passing liquids and unbound magnetic beads out of the micro-wells, while retaining the captured cells. In such implementations, once cells have been captured within the micro-wells, fluids can be introduced through the micro-wells to wash the captured cells. In one example, a wash step can be used to sieve free unbound magnetic beads and other small entities captured within the micro-well through the micro-pores.

In some implementations with many micro-well arrays, which require the length of the micro-well chip to be disproportionally larger than its width, the micro-well arrays, instead of being arranged in a linear manner can be arranged in a meandering pattern, which can enable packing more micro-wells on a rectangular surface.

Figure 1B:
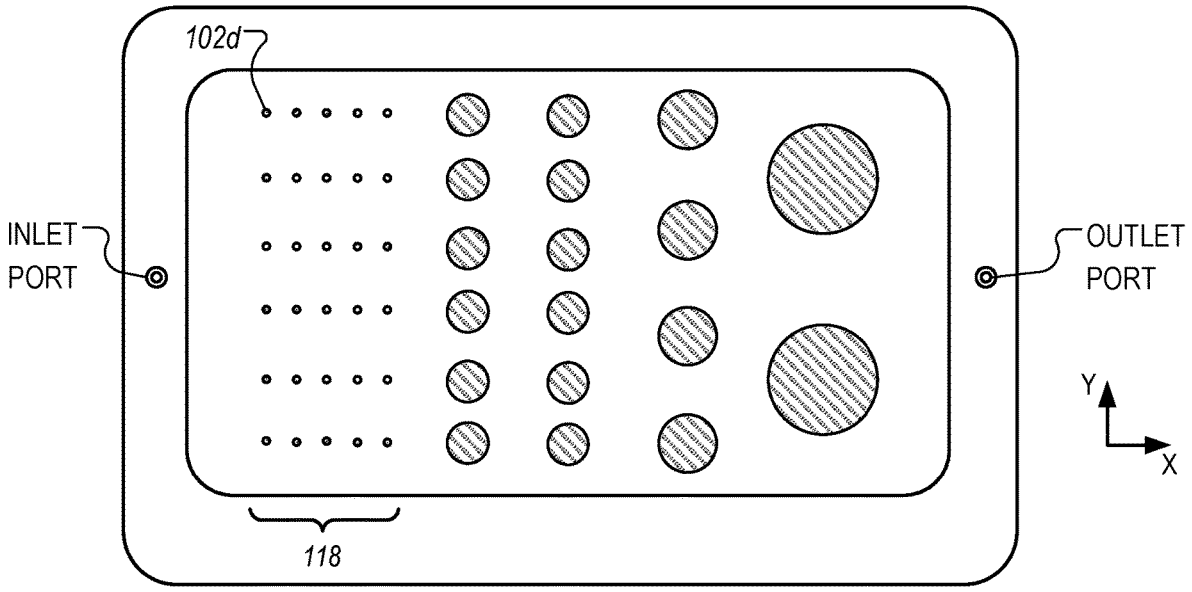
FIG. 1B is a schematic diagram of a top view of an example of a micro-well chip for use in the systems described herein.

FIG. 1B illustrates an implementation of the micro-well chip 110 that includes an array of micro-wells 118 placed upstream near the inlet port of the micro-well chip 110. The micro-well 102*d* can be used for capturing free unbound magnetic beads within the sample fluid. The dimensions of these micro-wells can be configured to be large enough to capture the magnetic beads, but also small enough such that cells within the fluid sample are unable to enter the micro-well 102*d*. In such implementations, the magnet 130 can initially be moved around these micro-wells to apply an attractive force on the unbound magnetic beads for capture within the micro-wells 102*d*.

Figures 1, 1C:
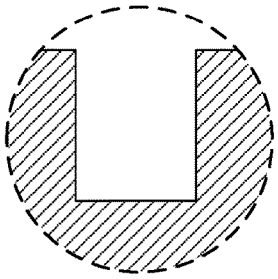
FIGS. 1C-1, 1C-2, 1C-3, and 1C-4 are cross-sectional diagrams that illustrate examples of micro-well shapes.
Figures 1, 1C, 2:
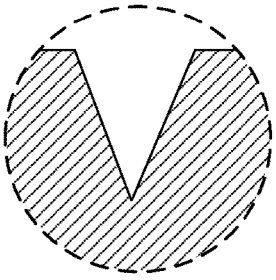
Figures 1, 1C, 2, 3:
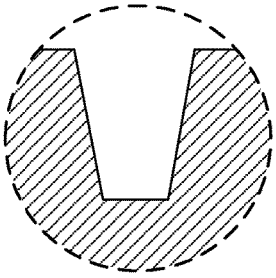
Figures 1, 1C, 2, 3, 4:
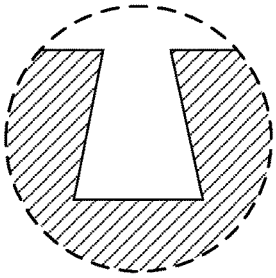

FIGS. 1C-1, 1C-2, 1C-3, and 1C-4 are cross-sectional diagrams that illustrate examples of micro-well shapes. FIG. 1C-1 illustrates an example of a cylindrical micro-well, FIG. 1C-2 illustrates an example of a conical micro-well, FIG. 1C-3 illustrates an example of a truncated conical micro-well, and FIG. 1C-4 illustrates an example of a reverse truncated conical micro-well. In the case of a truncated conical shape, the entrance of the micro-well can have a large diameter while the bottom of the micro-well can have a smaller diameter. Alternatively, in a case of the reverse truncated conical shape, the entrance of the micro-well can have a smaller diameter compared to the bottom of the micro-well to make it more difficult for a cell to escape from the micro-well. This arrangement can also help retain liquid for longer periods of time when the entirety of the micro-well chip is not in liquid but its micro-wells contain liquid.

Figure 2A:
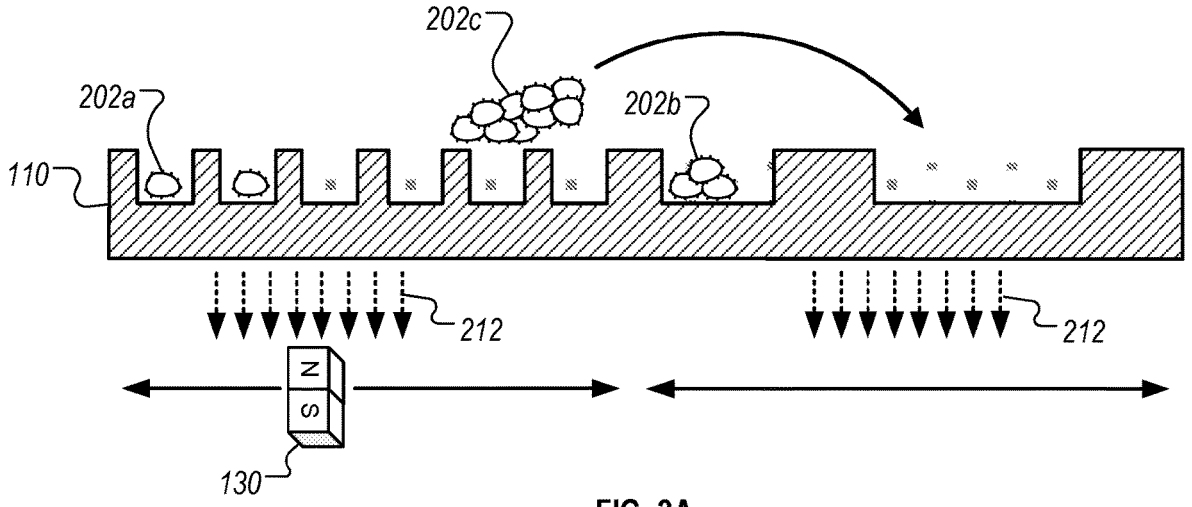
FIG. 2A is a schematic diagram that illustrates an example of magnetically-induced cell capture within a microfluidic chamber that includes a micro-well chip formed as part of the lower or bottom wall of the chamber.

FIG. 2A illustrates an example of magnetically-induced cell capture within a microfluidic chamber. The figure depicts a side cross-sectional view of the micro-well chip 110 situated in a chamber with an inlet port (not shown) of the chamber arranged on the left side of the micro-well chip 110 and an outlet port (not shown) of the chamber arranged on the right side of the micro-well chip 110. In this example, the magnet 130 is placed underneath the micro-well chip 110 and generates an attractive force 212 that assists in capturing individual cells (or smallest target entities) 202*a*, small cell clusters 202*b*, and large cell clusters 202*c* into different micro-wells on the surface of the micro-well chip 110. The magnet 130 is initially placed upstream (e.g., left side of the micro-well chip 110) to capture individual cells 202*a*. After individual cells are captured within the micro-wells (e.g., the array of micro-wells 110), the magnet 130 is then moved downstream to capture small cell cluster 202*b* and large cell cluster 202*c*.

In one implementation, the target entities can be introduced by a fluid flow through the inlet port and the fluid flow can be stopped or reduced while target entities are substantially located on the first array, so as to prevent the smaller target entities from escaping downstream and accidentally entering into larger wells of subsequent arrays. The magnet can be moved, e.g. horizontally, in an oscillatory fashion to ensure entry of small target entities (or individual cells) into the wells of the first array. Then the magnet can be moved downstream to lead larger entities (or clusters) into the larger wells of the next array. This process could be assisted by restarting or increasing fluid flow or alternatively without using any fluid flow. Once the process of capturing entities in the wells is completed, a wash process can be performed if necessary. In one implementation, the inlet and the outlet ports can inherently be parts of the micro-well chip 110.

The magnet can be moved underneath the micro-well chip 110 along two dimensions beneath the micro-well chip (e.g., along the x-axis and y-axis as depicted in FIGS. 1A-1B) either manually or automatically to follow various movement patterns to improve cell capture within the micro-wells of the micro-well chip 110. For instance, the magnet can be moved in a back-and-forth pattern along a single axis to repeatedly applying attractive forces over a certain region of the micro-well chip 110. In other instances, other patterns such as a circular pattern, a zig-zag pattern, raster scan, sigmoidal, or other patterns can also be used. Some implementations include the use of more sophisticated movement patterns based on the characteristics of the cells to be captured. For example, movement patterns can be defined and controlled externally by a user from a control unit that adjusts the movement of the magnet underneath the micro-well chip 110. In one implementation, a housing that accommodates the micro-well chip 110 can be configured to have a handle that is connected to the magnet. This handle can extend outside the housing by a sufficient amount so as to enable manual movement of the magnet.

As described herein, the magnitude of the attractive force 212 can also be adjusted to increase or decrease the magnetically-induced movement of the cells 202*a*, the small cell clusters 202*b*, and the large cell clusters 202*c* into the micro-wells. For instance, the magnet 130 can be moved or controlled to apply a smaller attractive force to induce individual cells 202*a* to be captured within micro-wells, and moved or controlled to apply a larger attractive force to induce cell clusters to be captured within the micro-wells due to the greater size of the cell clusters. In some instances, the magnitude of the attractive force 212 can be specifically modulated to selectively capture cells and/or cell clusters of a particular size or shape (e.g., selectively capturing small cell clusters 202*b*, but not large cell clusters 202*c*). For example, if the magnet 130 is a permanent magnet, the magnet 130 can moved closer to from the microfluidic chamber to increase the magnitude of the magnetic force applied and moved further away from the microfluidic chamber to decrease the magnitude of the magnetic force applied. In one implementation the distance between the magnet and the bottom of the chip surface can be between 10 micrometers and 2 centimeters, or more narrowly between 0.5 to 2 mm. In other examples, where the magnet 130 is an electromagnet, the amount of energy supplied to the magnet 130 can be increased or decreased to similarly increase to result in a corresponding increase or decrease in the magnitude of the magnetic force applied. In one embodiment the force exerted on a single magnetic, paramagnetic or superparamagnetic particle can be between 0.1 pN to 1 nN or more narrowly between 1 to 100 pN.

In some implementations, the surface of the micro-well chip 110 is capable of generating an electric field within the microfluidic chamber to adjust the movement of captured cells within the micro-wells. For example, the micro-well chip 110 can have an embedded modality (e.g., an electromagnet or an electric generator) that generates an electric field on the bottom surface of the micro-wells that repels negatively charged cells that are captured within the micro-wells to cause the captured cells to exit the micro-wells. The magnitude of the generated electric field can be modulated to perform specific operations on the captured cells. For example, a low magnitude electric field can be generated to adjust the placement of the cells within the micro-wells (e.g., can vibrate or agitate the cells in the micro-well) to enhance mixing with chemicals such as dyes, stains, lysates, etc., that are introduced into the micro-wells after capture. In another example, a high magnitude electric field can be generated to displace the cells from the micro-well and collect the cells through the outlet port of the microfluidic chamber. In some implementations, the particles or beads that are used to bind to the target entities can bear a negative or positive charge in a manner that helps attract or repel the target entities by means of an external electric field. In some embodiments, the magnitude of the force that results from the electric field on a target entity can be between 0.01 pN to 1 nN.

Figure 2B:
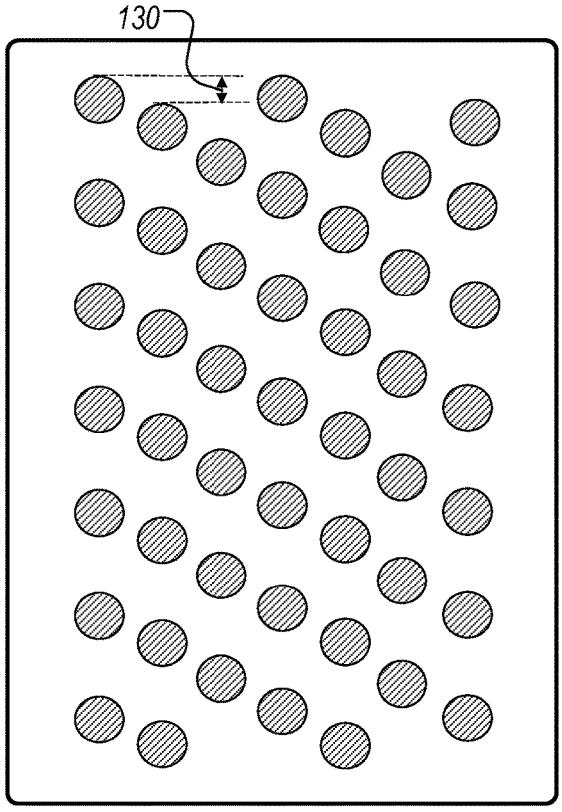
FIG. 2B-D are schematic diagrams that illustrate examples of different micro-well arrays.

FIG. 2B illustrates an example of a micro-well array on a micro-well chip. In the example depicted, the array is arranged as successive columns that are each offset by a distance 130 such that micro-wells that are included in a column are offset with respect to the micro-wells of a preceding column. This distance 130 can be, for example, 1, 5, or 10 micrometers. This type of arrangement can be used to enhance a probability of a target entity being captured in a micro-well during fluid motion, e.g., horizontal motion, across the micro-well chip surface, which is depicted in greater detail in FIG. 2C.

Figures 1, 2C:
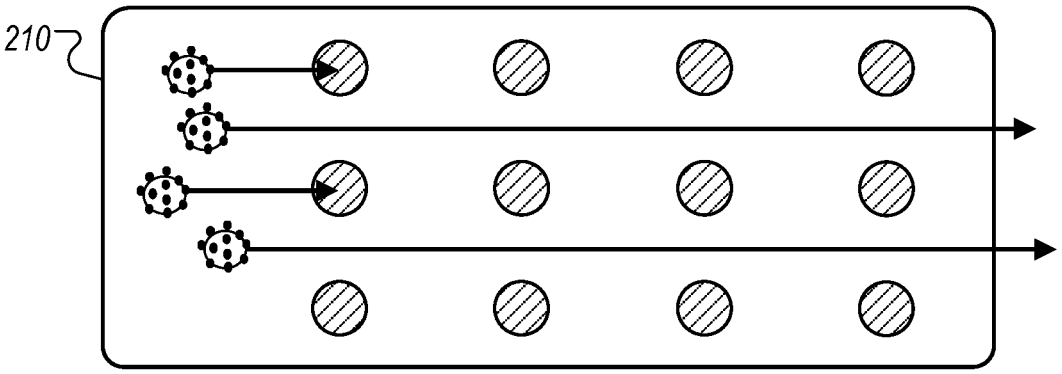
Figures 2, 2C:
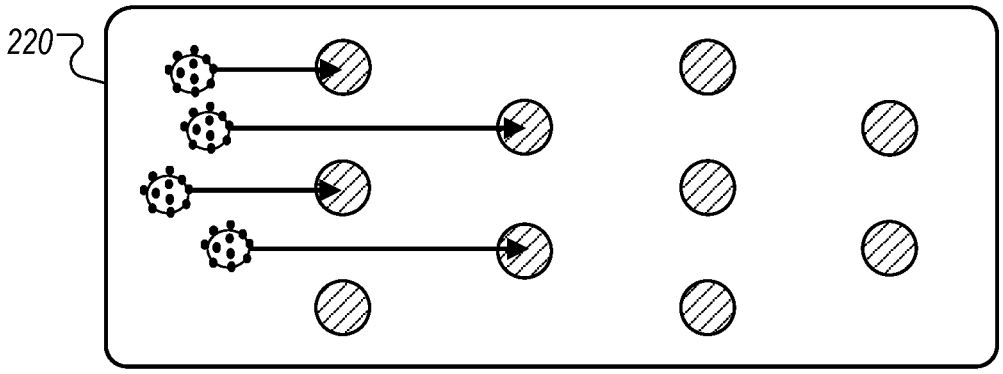

FIGS. 2C-1 and 2C-2 illustrate two examples of micro-well arrays and their impact on target entity capture within a micro-well during horizontal fluid flow across the surface of a microchip. For example, chip 210 includes a grid-like array where micro-wells are arranged horizontally and vertically parallel with respect to one another. With this type of arrangement, if the micro-wells are sparsely spaced out on the surface of the chip 210, then some target entities may be unable to be captured during horizontal fluid flow or horizontal motion caused by magnetic and/or fluid forces, while in contact with the chip surface, because these target entities flow along a portion of the surface that is spaced between two parallel rows of micro-wells. This arrangement of micro-wells can therefore reduce the overall likelihood that a micro-well will be included in a horizontal path of a target entity as it flows across the surface of the chip 210.

In contrast, chip 220 shown in FIG. 2C-2 includes an alternating array similar to the array depicted in FIG. 2B where micro-wells of different columns are vertically offset from micro-wells of the nearest column. With this type of arrangement, the likelihood that a target entity will pass through the surface of the chip 220 without encountering a micro-well is reduced compared to the likelihood on the surface of the chip 210. In this regard, the arrangement of the micro-well array can be used to improve capture efficiency without necessarily increasing the density of micro-wells that are placed on the surface of a micro-well chip. For instance, in the examples depicted in FIG. 2C, although the chip 220 includes a similar or a lower number of micro-wells, the increased probability of a target entity encountering a micro-well during a horizontal path can cause increased capture efficiency. Capture efficiency can be further adjusted based on the offset distance, which in various implementations, can be adjusted between 0% (e.g., no offset as illustrated in chip 210) and 100% (e.g., an offset equal to the diameter of a micro-well) or more, e.g., by a distance of 150% or 200% of the diameter of a micro-well, or less, e.g., by a distance of about 10%, 25%, 50%, or 75% of the diameter of a micro-well. The offset can also be made as small as possible to maximize the probability of a cell overlapping with a well. For example, if the offset is about the same as the diameter of a micro-well, as shown in FIG. 2C-2, there can be still a possibility that a horizontal path of a cell may be exactly in between successive rows of micro-wells. If this takes place, a cell may still not enter into a micro-well, because it will only partially overlap with the entrance of a micro-well.

Figure 2D:
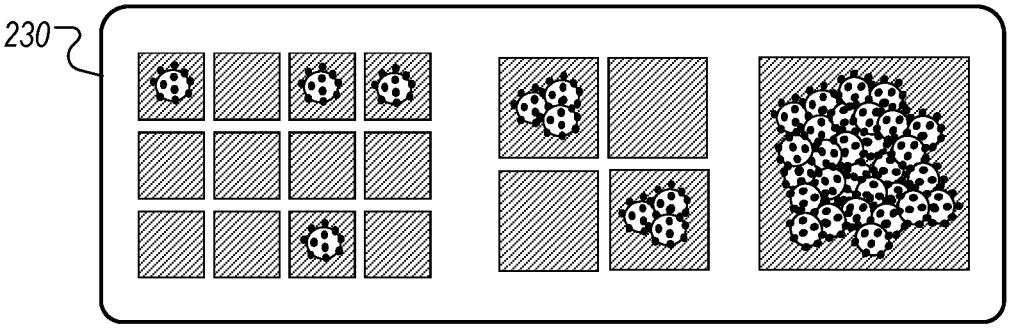

FIG. 2D illustrates an example of a micro-well array where the shapes of the micro-wells are squares or rectangles. In this example, a chip 230 includes square or rectangular-shaped micro-wells that can be helpful in breaking apart individual cells that have been clustered via non-specific adsorption and/or magnetic aggregation. The arrangement can include micro-wells of different sizes to capture individual target entities or portions of aggregates as a large cluster moves along the surface of the chip 230. For instance, as a large cluster moves along the surface of the chip 230, individual target entities that are broken apart from the cluster can be captured in the smallest micro-wells near the left side of the chip 230 whereas intermediate-sized clusters that are broken apart can be captured in the medium-sized micro-wells near the center of the chip 230. The spacing between the micro-wells can be used to enhance the impact of the micro-wells in breaking apart clusters. For example, the distance between edges of micro-wells on the surface of the chip 230 can be minimized to enhance the disaggregating effect on a large cluster.

Figure 2E:
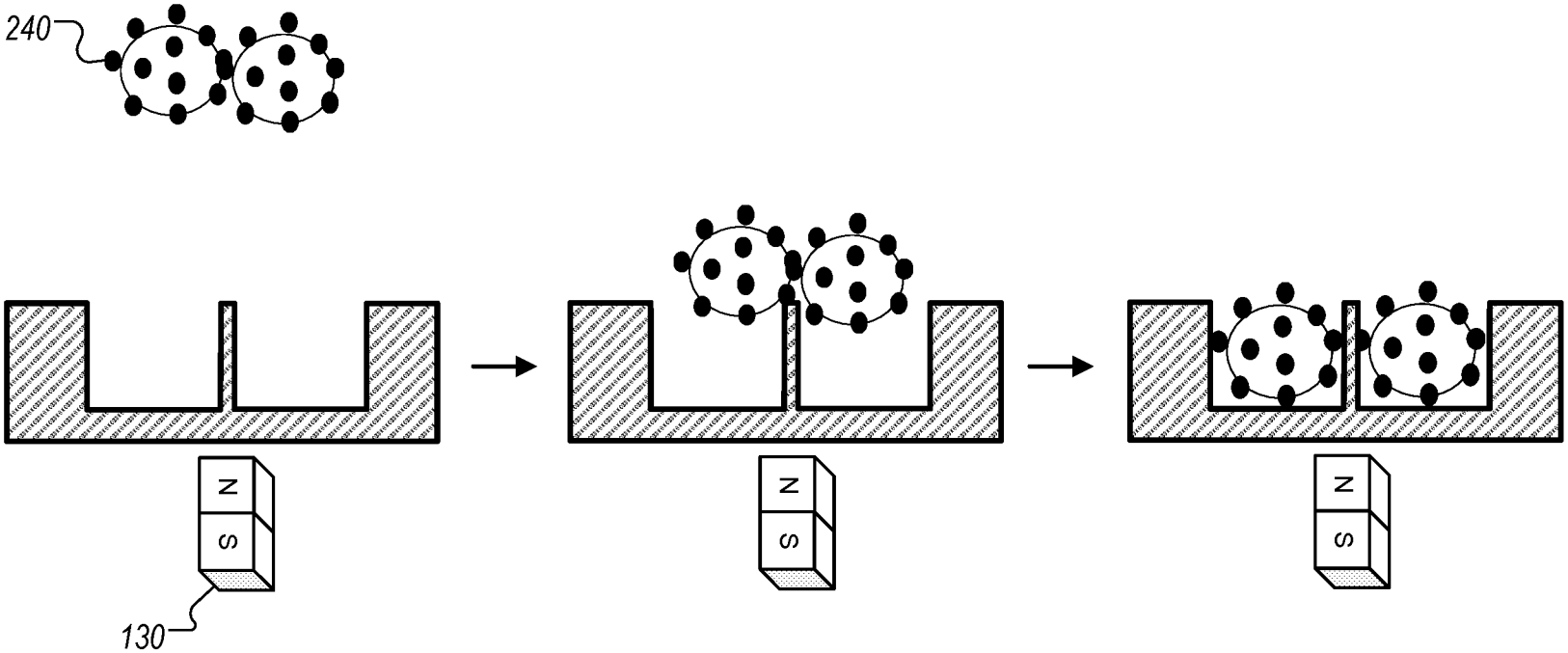
FIG. 2E is a cross-sectional side view schematic of an example of a magnetically-induced cell capture system that can be used to separate individual cells of a cell cluster into different micro-wells.

FIG. 2E is a schematic diagram that illustrates a disaggregating effect that rectangular-shaped micro-wells can have on a cluster 240. In the example, the cluster 240 includes two individual target entities that are exposed to a magnetic force by the magnet 130 placed underneath two micro-wells. As depicted, as the cluster 240 travels toward the surface of the micro-well chip, the edges formed by the rectangular-shaped micro-wells can potentially separate the individual target entities of the cluster 240 and capture each entity within a different micro-well. This disaggregating effect can also occur with cylindrical micro-wells (i.e. those that have circular opening), but is enhanced with rectangular-shaped micro-wells. In some implementations the opening of the wells may be pentagonal, hexagonal, octagonal or triangular.

Figure 2F:
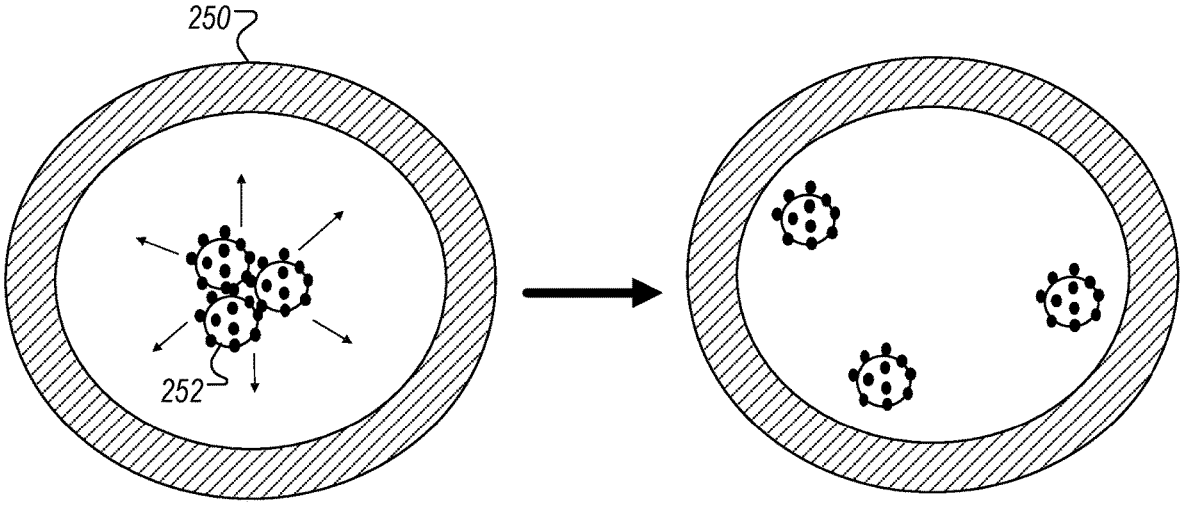
FIG. 2F is a schematic diagram of an example of a technique for disaggregating and/or separating magnetic or magnetized target entities.

FIG. 2F is a schematic diagram of an example of a technique for disaggregating and/or separating magnetic or magnetized target entities. In the example, a ring-shaped magnet 250 is placed around a target entity cluster 252, which is composed of three target entity cells. An outward magnetic force is applied by the magnet 250 to help separate and/or disaggregate individual target entities that form the cluster 252. In one implementation, the magnet 250 is situated below a micro-well chip to apply both a downward magnetic force and an outward radial magnetic force, which collectively pull the magnetized target entities into micro-wells while disaggregating clusters such as the cluster 252. In other implementations, the magnet 250 can be substantially co-planar with the surface of the micro-well chip to primarily apply an outward radial magnetic force to only separate and/or disaggregate the target entities without necessarily applying a down magnetic force toward the surface of the micro-well chip. 1

Figure 2G:
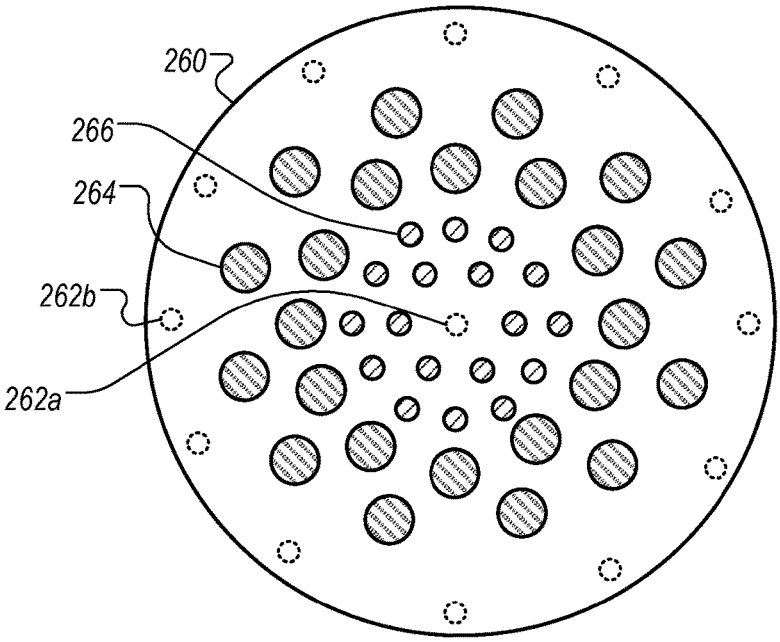
FIG. 2G is a schematic diagram of an example of a micro-well device having a circular substrate and micro-well arrays in two concentric circles.

FIG. 2G is a schematic diagram of a micro-well array device having a symmetrical, e.g., circular, substrate 260. The circular substrate 260 includes the micro-wells in concentric circular arrays around a central location devoid of micro-wells. The fluid sample is added to the central location in the middle of the substrate, e.g., via an inlet 262*a*, or by pipette, and would be made to flow radially outwardly from the center across the micro-wells to outlets 262*b* at the edges of the device, for example, when the device is spun at the right speed to cause the liquid sample to flow and/or the target entities to move at the appropriate rate/speed. The fluid sample can be added to a clean, e.g., dry, micro-well array device, or can be added after a buffer or other fluid has been applied to the substrate surface, e.g., to "prime" the surface and the micro-wells, e.g., to remove air bubbles in the micro-wells.

A flow of the target entities in a fluid sample can be created by a pump and/or vacuum arranged at the inlet and/or outlets of the system, or a flow can be created by rotating the symmetrical, e.g., circular or octagonal substrate. For example, the diameter of the substrate can range from 3 mm to 30 cm, e.g., from 2 cm to 10 cm (e.g., 3, 4, 5, 6, 7, 8, 9, 10, 15, 20, 25, 30, 40, 50, 75, or 100 mm or 1, 2, 3, 4, 5, 6, 7, 8, 9, 10, 15, 20, 25, or 30 cm). In one implementation the rotational speed of the substrate can range from 0.0001 rpm to 1000 rpm, e.g., from 0.01 rpm to 20 rpm (e.g., 0.0001, 0.0005, 0.001, 0.005, 0.01, 0.05, 0.1, 0.5, 1.0, 2.5, 5, 7.5, 10, 12.5, 15, 17.5, 20, 25, 30, 40, 50, 75, 100, 200, 250, 250, 500, 750, or 1000 rpm).

In this implementation, the arrays of micro-wells are arranged as concentric circles with the circle (or circles) of the smallest micro-wells 266 arranged closest to the center of the device, and the circle (or circles) of the largest micro-wells 264 arranged furthest from the center of the device. One magnet can be arranged below the substrate to cause magnetic target entities to enter the micro-wells and be held in the micro-wells. Alternatively, one or more magnets can be arranged adjacent, e.g., below, the substrate and configured and controlled to be move to cause the target entities to move, e.g., radially outwardly, towards subsequent circular arrays of micro-wells. In some embodiments, electromagnets, e.g., a circular electromagnet or a series of circular electromagnets can be arranged, e.g., below the substrate, and triggered in sequence to provide a magnetic force in a radially outward direction to move the target entities on the surface of the device.

Cell Capture and Analysis Systems

The micro-well chip 110 can include various features to enable the capture of target entities such as cells within a fluid sample flowing over the micro-well chip, e.g., flowing through a microfluidic chamber that contains the micro-well chip either as a separate and removable plate at the bottom of the microfluidic chamber, or formed as part of the bottom wall of the chamber. For instances, the micro-well chip 110 can include structural features that adjust the flow of the fluid sample to enable the capture of cells within a particular location of the microfluidic chamber. As an example, the micro-well chip 110 can include fluidic circuits with bifurcations and/or valves in a predetermined arrangement that assist in segregation of fluid from cellular components. In other instances, the surfaces of the micro-well chip 110 can be functionalized to enhance cell capture using receptor-ligand binding between particular chemicals used to functionalize the surfaces of the micro-well chip and the receptors expressed on the surfaces of the target cells. In some instances, the micro-wells can be selectively functionalized to recognize specific types of cells and molecules. For example, the inner walls of the micro-wells can be coated and/or functionalized with binding moieties as described herein to aid in retaining the target entities within the micro-wells. In some implementations, a combination of structural features (e.g., channel dimensions and channel arrangement) and functional features (e.g., binding moieties bound to surfaces of channels and/or inner surfaces of the micro-wells) are used to enhance cell capture within the micro-well chip 110.

Micro-Well Chip Fabrication

The micro-well chip 110 can be fabricated using commonly used microfabrication techniques for silicon such as photolithography and etching. In some instances, the micro-well chip 110 is a single surface structure that is situated inside a fluidic chamber that has a transparent upper surface that allows for viewing and analysis of captured cells. In other instances, the micro-well chip 110 is constructed by combining multiple pre-fabricated layers where the top layer (and in some implementations the bottom layer) is made of, or includes a window of, a transparent material such as glass, quartz, or plastic (e.g., acrylic, polyvinyl chloride, polypropylene, or polystyrene). In such instances, the micro-well chip 110 can include a bottom layer that includes an arrangement of micro-wells as depicted in FIG. 1A, a spacer layer that forms the height or side walls of the microfluidic chamber, and a top layer that encloses the microfluidic chamber. As described more particularly with respect to FIGS. 3A-3B, in some instances, the top layers of the micro-well chip 110 can be detachable to enable extraction of captured cells. In some implementations, the bottom of the each micro-well are made of a transparent material or can include windows of a transparent material.

In some implementations, micro-wells of the micro-well chip 110 are constructed by initially forming holes in a polydimethylsiloxane (PDMS) film and then applying the film to a surface of a solid material such as glass. In such implementations, the PDMS film can be placed on the solid surface to "cap" the through holes on the bottom of the solid material so as to form micro-wells to be used for capturing cells.

In one implementation, the micro-well chip 110 can be made out of a metal such as aluminum or stainless steel to enable efficient conduction for temperature control for applications that include polymerase chain reaction (PCR). The micro-well chip can be coated or patterned with gold or platinum or a similar material that enables functionalization with other molecules including thiols.

In some implementations the surface area of the micro-well chip 110 can range from 100 $\mu m^2$ to 1000 $cm^2$ or more narrowly from 0.01 $mm^2$ to 100 $mm^2$. In one implementation the size of the micro-well chip 110 can be 15 cm by 10 cm so that it is comparable to the size of an adult human hand. The micro-well chip 110 can be composed of micro-wells that have 30 micrometer entrance diameters with 40 micrometers of center-to-center spacing. In this implementation the micro-well chip can have approximately 6 million micro-wells. In another implementation the micro-well chip 110 can have dimensions of 20 cm by 15 cm, and can therefore contain 12 million of the same micro-wells.

In other implementations, the separation between the micro-wells can be different and range from 1 micrometer (edge-to-edge) to 200 micrometers center-to-center (or 170 micrometers from edge-to-edge for a micro-well with a 30 micrometer entrance diameter). The number of micro-wells that are packed onto the surface of the micro-well chip 110 can then vary accordingly. For example, about 1 billion micro-wells can be present in a 11 cm by 3.7 cm micro-well chip 110 if a micro-well's entrance diameter is 1 micrometer and if micro-wells are spaced by 1 micrometer (edge-to-edge) from each other. As another example, 100 million micro-wells can be present in a 17.7 cm by 6 cm micro-well chip 110 if the micro-wells' entrance diameter as well as edge-to-edge spacing are 5 micrometers. In some implementations, the diameter of the entrance of a micro-well can range from 10 nm to 500 μm.

In one implementation, a "cartridge" or a housing that contains the micro-well chip can be made out of injection molded plastic. The plastic can contain a transparent observation window. In another implementation the housing can be made out of acrylic or metals or wood.

In one implementation the length and width of the housing can be 1 millimeter to 5 cm larger than those of the micro-well chip 110. The thickness of the housing can vary between 1 millimeter to 5 centimeters.

Cell Access and Extraction Techniques

Figure 3A:
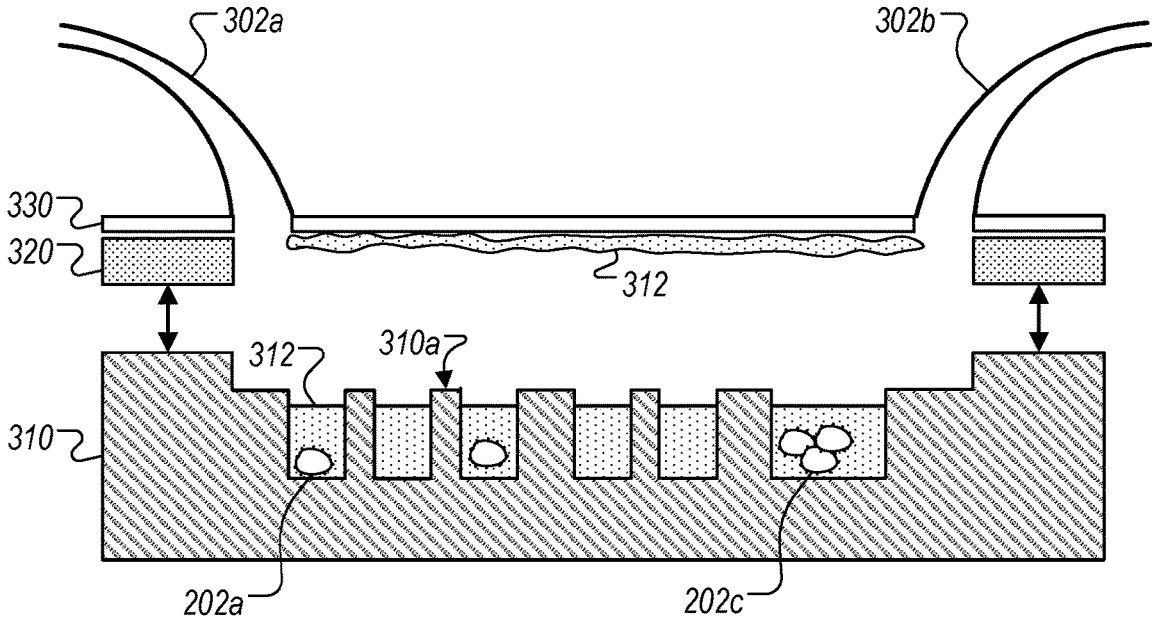
FIGS. 3A-B are cross-sectional side views that illustrate examples of micro-well chips with detachable surfaces that together form a microfluidic chamber in FIG. 3A and form a stand-alone micro-well chip in FIG. 3B.
Figure 3B:
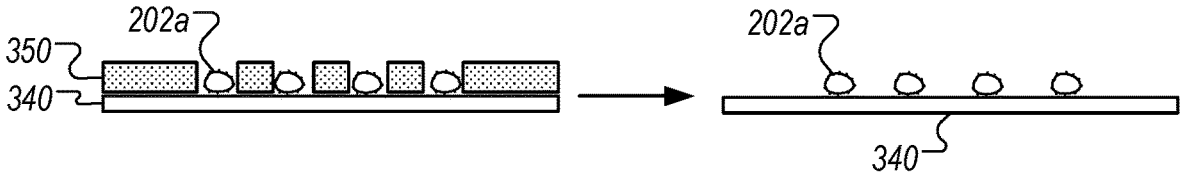
Figure 4A:
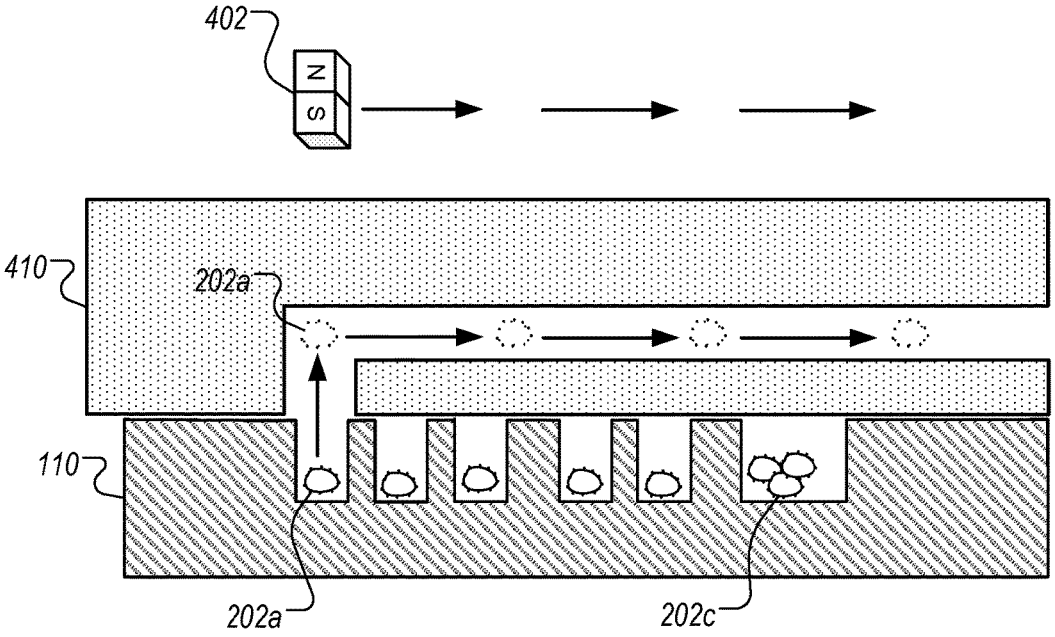
FIGS. 4A-B are cross-sectional diagrams that illustrate examples of two different cell extraction modules for use with the micro-well chips and microfluidic chambers described herein.
Figure 4B:
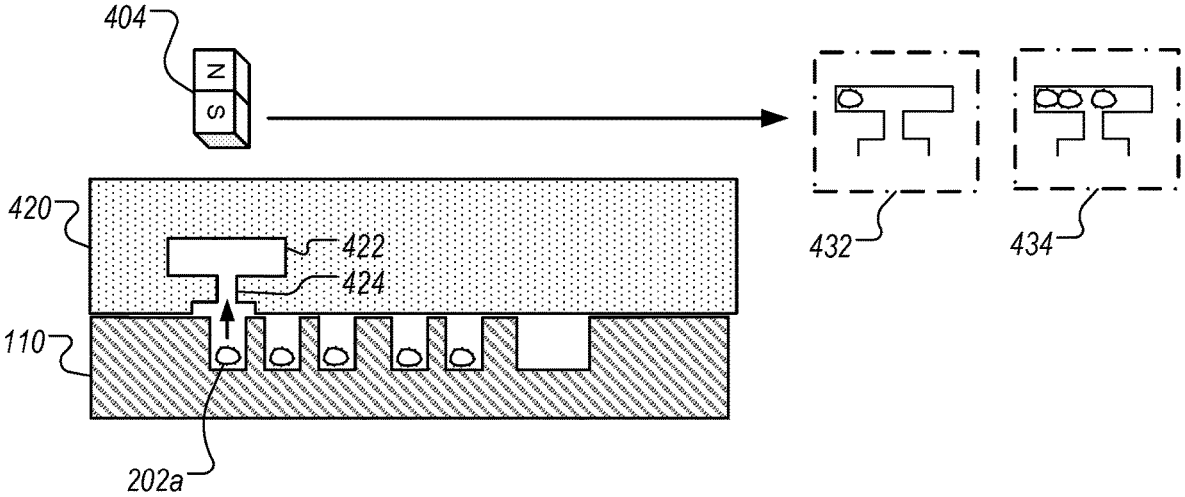
Figure 5:
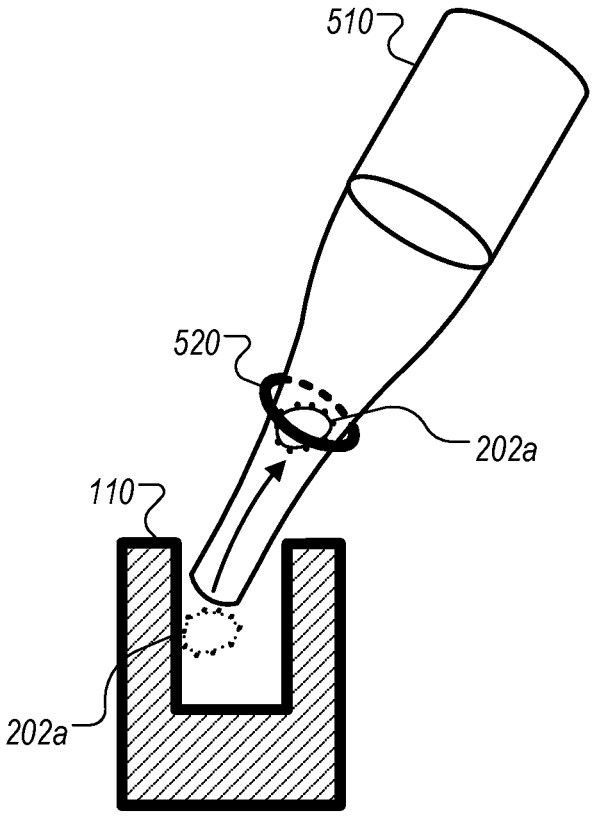
FIG. 5 is a schematic cross-sectional side view that illustrates an example of a single cell extraction device and technique.

In general, once cells have been captured within the micro-wells of the micro-well chip 110, the captured cells can be viewed, imaged, or accessed for further analysis or processing using different techniques. In some implementations, the fluid flow through the microfluidic chamber and/or the magnitude of the attractive force applied by the magnet can be adjusted to remove the captured cells from the micro-wells. In some implementations, one or more surfaces of micro-well chip 110 are disassembled to directly view or access the captured cells as depicted in FIGS. 3A-3B. Alternatively, in some implementations, a separate cell extraction module are used to extract the captured cells as depicted in FIGS. 4A-4B, and 5, in the presence or absence of fluid flow through the chamber. Although the descriptions below provide examples of such techniques, in some implementations, other extraction techniques are also used.

The extracted cells can be further analyzed with a different system (e.g., fluorescence analysis, polymerase chain reaction (PCR) modules, next generation DNA or RNA sequencing modules, plate readers, 2 or 3 dimensional cell culturing modules, high-content analysis devices like Opera etc.), collected to be transported out of the micro-well chip 110, or accessed to be cultured on the micro-well chip 110. As described more particularly below, various implementations include structural features that provide such functionalities.

FIGS. 3A-3B illustrate examples of micro-well chips with detachable surfaces. Referring initially to FIG. 3A, in one implementation, a micro-well chip can include a base 310 that includes micro-wells as described previously with respect to FIGS. 1A, 1B, and 2. A spacer 320 and a top plate 330 can be stacked on top of the base 310 such that the stacked elements create a space between a surface 310*a* of the base 310 and the top plate 330 corresponding to the microfluidic chamber. In some instances, the spacer 320 is constructed from PDMS, and the top plate 330 is constructed from a transparent material such as glass or plastic. In other instances the spacer 320 can be another polymer material or an O-ring. In one implementation the thickness of the spacer 320 can be between 0.25 to 1 mm. In other implementations the thickness of the spacer 320 can range from 0.01 mm to 10 mm. In some implementations, the width of the spacer 320 can range from 0.1 mm to 10 cm.

The microfluidic chamber is attached to an inlet 302*a*, which enables the fluid sample to enter the microfluidic chamber, and an outlet 302*b*, which enables the fluid sample to exit the microfluidic chamber. The fluid sample includes individual cells 202*a* and cell clusters 202*c* to be captured in the micro-wells of the base 310 using techniques described previously with respect to FIGS. 1A, 1B, and 2.

In the example depicted, once the cells 202*a* and cell clusters 202*c* have been captured within the micro-wells of the base surface 310, the spacer 320 and the top plate 330 can be detached from the base 310 to enable direct access to the captured cells. For instance, the captured cells can be accessed visually for optical analysis and/or accessed physically for extraction. After detachment, fluid media 312 in the microfluidic chamber can remain within the micro-wells so that the captured cells do not dry out after detachment. This is accomplished by configuring the micro-wells with a sufficient depth such that the capillary forces from the top plate 330 on the fluid media 312 do not remove all of the fluid media within the micro-wells. Furthermore, the surface of the micro-wells can be configured to possess a certain degree of hydrophilicity to retain as much water as possible. In an alternative implementation, the micro-wells can be shallower but as soon as the top plate 330 is removed, more fluid 312 can be added to prevent drying of the cells, or the removal of the top plate 330 can be accomplished while the entire device is submerged in a bath of liquid 312. A magnet can be present underneath the base 310 so as to prevent the escaping of the cells from the micro-wells during the detachment of the top plate 330.

Referring now to FIG. 3B, in an alternative implementation, a micro-well chip includes a base 340 that is a glass slide such as a common microscope slide where samples are placed prior to image analysis, and a porous layer 350 that includes holes that act as micro-wells to capture cells 202*a*.

In some implementations, the surface of base 340 are functionalized with molecules that promote cell adhesion to improve capture efficiency of the cells 202*a*. Once the cells 202*a* are immobilized to the surface of base 340, the porous layer 350 can be removed to provide direct access to the immobilized cells. The base 340 with the immobilized cells can be immersed in a fluid bath or placed in a fluidic chamber for additional analysis (e.g., fluorescence microscopy).

In other implementations, instead of being a functionalized surface, the surface of base 340 can instead be a free surface or a surface that is blocked with a non-fouling agent such as bovine serum albumin (BSA), polyethylene glycol (PEG), zwitterionic materials or other materials that block non-specific binding. In such implementations, an attractive force can be applied by the magnet 130 underneath the base 340 to inhibit cell movement when the porous layer 350 is detached from the base surface 340.

Figures 1, 3C:
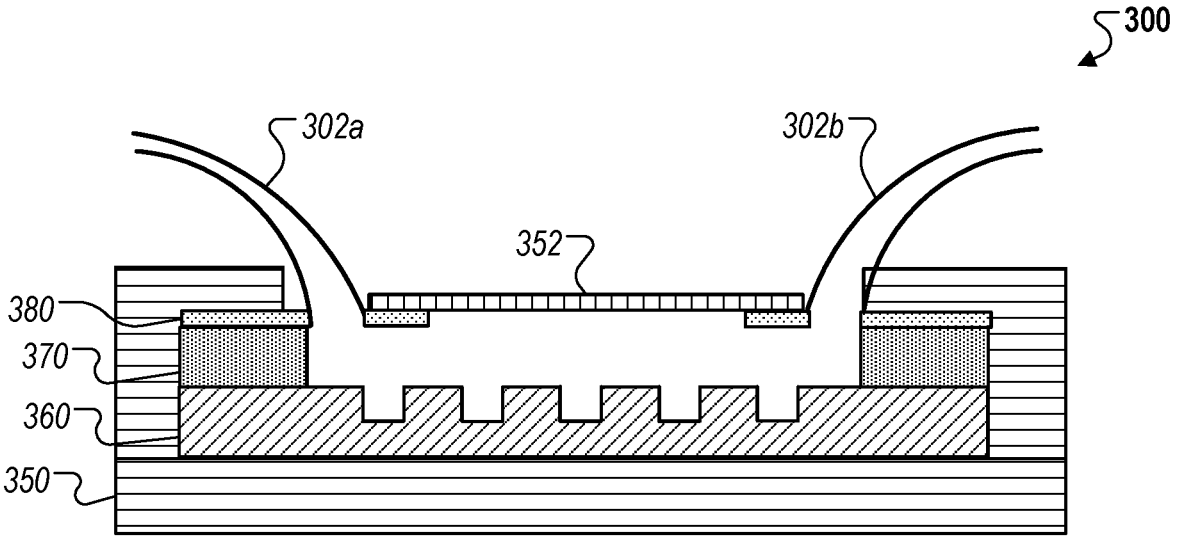
FIGS. 3C-D are schematic diagrams that illustrate an example of a cell capture system that enables access to target entities that are captured within micro-wells.
Figures 2, 3C:
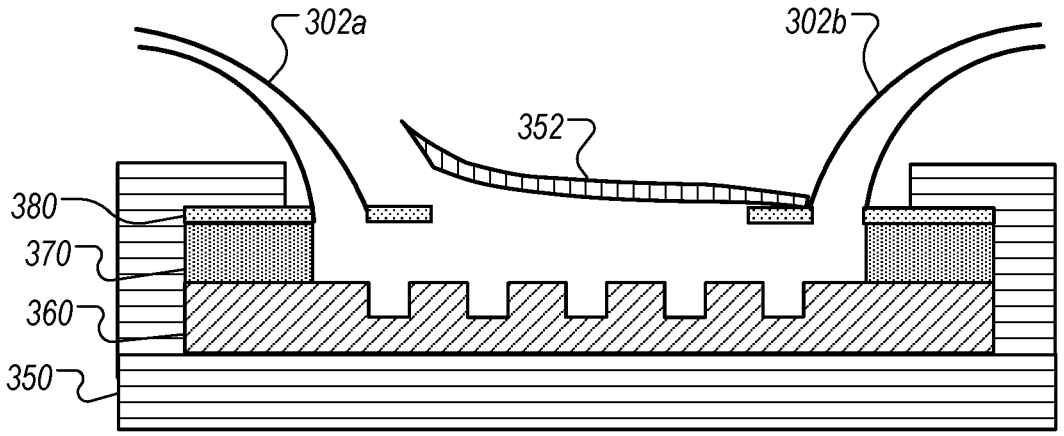
Figure 3D:
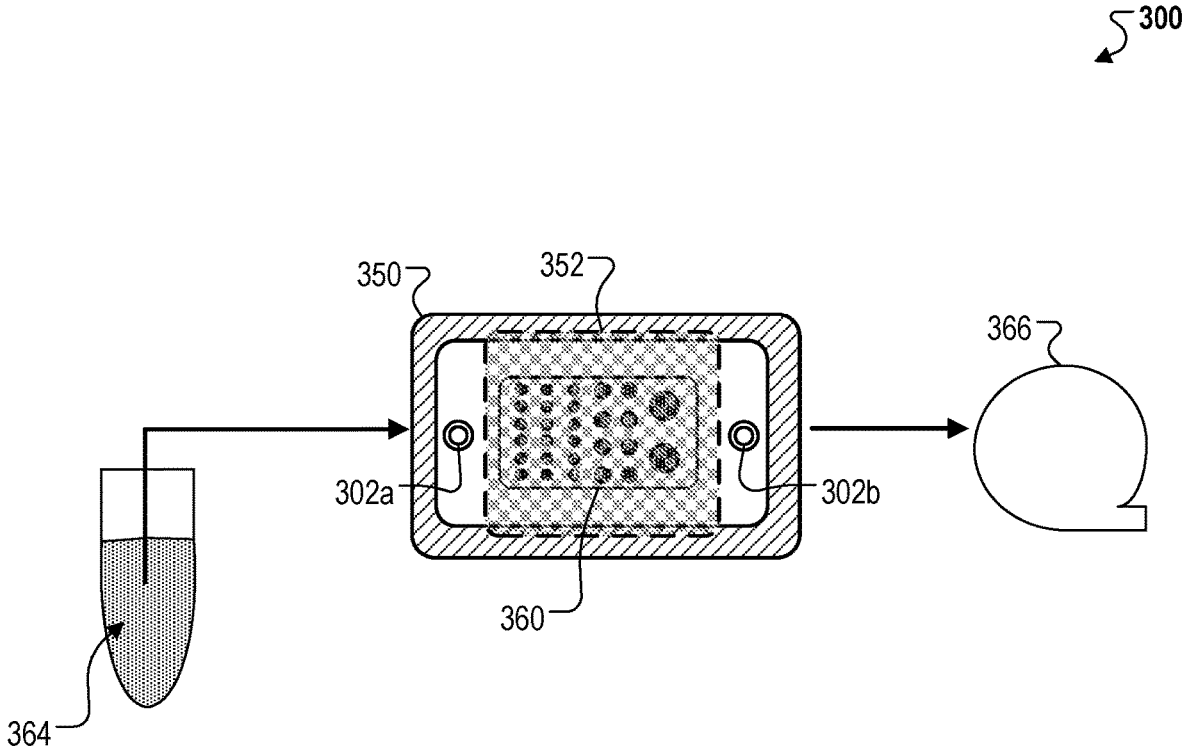

FIGS. 3C-3D are schematic diagrams that illustrate an example of a cell capture system 300 that enables access to target entities that are captured within micro-wells. Referring initially to FIG. 3C, cross-sectional diagrams of the cell capture system 300 are shown.

The system 300 includes a housing 350 that holds a micro-well chip 360 with multiple micro-wells placed on its surface. A spacer 370 is placed between the micro-well chip 360 and a transparent sheet 380 to form a chamber where a fluid sample containing target entities is introduced for a cell extraction operation. The fluid sample enters the chamber through the inlet 302*a* and exits the chamber through the outlet 302*b* in a similar manner as discussed above with respect to FIGS. 3A-3B. The system 300 also includes a removable and flexible (e.g., rubber-like) layer 352 that is capable of forming a seal and being peeled off or detached to provide direct access to contents of the chamber as depicted in FIG. 3C. In one implementation the height of the fluidic chamber may be between 0.1 mm to 1 cm, or more narrowly between 0.5 mm and 2 mm. In some implementations, this height may be defined by the thickness of the layer 370. In one implementation, the length and the width of the fluidic chamber may be defined by those of the micro-well chip, or the portion of the micro-well chip that contains the micro-well arrays. In other implementations, the length and the width of the fluidic chamber may range from 100 μm to 20 cm.

In a particular implementation, the housing 350 is constructed from acrylic, the spacer 370 is constructed from PDMS, and the transparent sheet 352 can be constructed from glass or any other suitable transparent (or opaque) material to allow the transmission of light into the chamber. The layer 352 can be a PDMS film that is capable of being peeled off the top surface of the transparent sheet 352. In other implementations, other suitable materials can be used as replacements to construct the system 300.

During a typical cell capture operation, the layer 352 is initially affixed to the top surface of the transparent sheet 380 to provide a sealed chamber that enables liquid flow with minimal leakage. A fluid sample containing target entities is then introduced into the sealed chamber through the inlet 302*a*. As the fluid sample flows from the inlet 302*a* to the outlet 302*b*, target entities and/or cell clusters are captured in the micro-wells of the chip 360 as described above. The layer 352 can then be removed as shown in FIG. 3C to provide direct access to the cells that have been captured in the micro-wells of the chip 360 once a volume of the sample fluid has flowed through the chamber. For example, captured cells within the micro-wells can be manually extracted using a pipette after the layer 352 has been removed. In some implementations sufficient fluid remains in the chamber after the peeling or removal of layer 352 so that the target entities in the wells remain hydrated. In some implementations only the micro-wells contain fluid after the removal of the layer 352, so that each micro-well is fluidly disconnected from the other micro-wells. In other implementations, the amount of fluid that remains in the chamber after removal of layer 352 can be as much as 100% of the volume of the chamber.

Various techniques can be employed to ensure that the layer 352 is sufficient to sustain a leakage-free fluid flow as the sample fluid is introduced into chamber through the inlet 302*a*. For example, in some implementations, the structure of the system 300 can be reinforced by mechanical pressure applied by a plastic structure (e.g., acrylic) that is placed on top of the layer 352 as fluid flows through the chamber.

Referring now to FIG. 3D, a schematic diagram of the cell capture system 300 where a fluid control device 366 is placed downstream of the micro-well chip 360 is shown. In this example, the fluid control device 366 exerts a "pulling" force that causes fluid sample to flow from a sample chamber 360 to a fluid chamber (e.g., a chamber formed by the transparent layer 380, the spacer 370, and the micro-chip micro-well 360 as depicted in FIG. 3C) through the inlet 302. The pulling force then causes the fluid sample to flow out of the fluid chamber through the outlet 302*b*. The pulling force causes a reduced pressure inside the chamber and hence enhances the seal by causing the layer 352 to press down on layer 380. This type of pulling force can be used as an alternative means to ensure leakage-free fluid flow without requiring mechanical pressure reinforcement as described above.

FIGS. 4A-4B illustrate examples of different cell extraction modules. Referring to FIG. 4A, a tunnel extraction module 410 can be used to extract captured cells 202*a* within individual micro-wells of the micro-well chip 110 and transport the extracted cells to a separate location for further analysis or processing. Referring to FIG. 4B, in another implementation, an enclosed extraction module 420 can be used to extract captured cells 202*a* into a collection compartment 422 that stores one or multiple cells from one or more various micro-wells of the micro-well chip 110.

The tunnel extraction module 410 can have an entrance that has a diameter larger than the diameter of the entrance of a micro-well on the surface of the micro-well chip 110. In addition, the diameter of the entrance of the tunnel extraction module 410 can be configured such that the entrance can be used to extract a captured cell 202*a* from only a single micro-well without overlapping with the entrance of another micro-well. In some instances, the tunnel extraction module 410 is constructed with a flexible rubber-like material, e.g., polymers such as PDMS, to form a seal with the surface of the micro-well chip 110 around the entrance of the micro-well. Alternatively, the extraction module 410 can be made from plastic or metals such as stainless steel and be configured to have a sheet of polymeric material such as PDMS on the bottom surface of it to form a seal around a micro-well. In addition, the tunnel extraction module 410 can also be filled with liquid (e.g., media fluid) to accommodate the captured cell 202*a* during the extraction process. In such instances, the bottom of the micro-well includes one or more entrances to allow the passage of liquid through the micro-well for suction force applied by the tunnel extraction module 410.

In the example depicted in FIG. 4A, a magnet 402 is placed above the tunnel extraction module 410 to apply an attractive force that is used to levitate the captured cell 202*a* from the micro-well and into the entrance of the tunnel extraction module 410. The placement of the magnet 402 can then be adjusted to assist the movement of the captured cell 202*a* through the tunnel of tunnel extraction module 410. The other end of the tunnel can lead to a separate container that accommodates the captured cell 202*a*. After the captured cell 202*a* has been extracted, the tunnel extraction module 410 can then be adjusted and placed over another micro-well to repeat the extraction process for another micro-well.

Referring now to FIG. 4B, the enclosed extraction module 420 can have an entrance that has a diameter larger than the diameter of the entrance of a micro-well on the surface of the micro-well chip 110, but also includes a narrow region 424 that has a diameter smaller than the effective diameter of the captured cell 202*a*. This requires that the captured cell 202*a* deforms prior to entering the narrow region 424 and enters into the collection chamber 422, preventing the captured cell 202*a* from exiting the collection chamber 422 after the extraction procedure has been completed. Like the tunnel extraction module 410, the enclosed extraction module 420 can also be constructed from a flexible rubber-like material to form a seal with the surface of the micro-well chip 110 around the entrance of the micro-well. Alternatively, the extraction module 420 can be made out of plastic or metal and be configured to have a sheet of flexible material on its bottom surface to form a seal around a micro-well. The collection chamber 422 can also be filled with fluid using a separate dispensing channel (not shown in the figures) to periodically provide fluid to accommodate the extracted cells within the collection chamber 422.

In the example depicted in FIG. 4B, a magnet 404 can be placed on top of the enclosed extraction module 420 to provide an attractive force in assisting with the extraction of the captured cell 202*a* from the micro-well into the collection chamber 422. Compared to the magnet 402, the magnet 404 is capable of providing an attractive force with a greater magnitude necessary to cause deformation required for the captured cell 202*a* to pass through the narrow region 424 before entering the collection chamber 422. Once the extraction procedure is complete, the enclosed extraction module 420 can then be moved to another micro-well. The narrow region 424 can help prevent a collected cell from escaping from the chamber. As depicted in dashed lines at 432 and 434, after each extraction procedure, the number of captured cells within the collection chamber 422 increases. Once all of the desired cells have been extracted from the micro-well chip 110, the enclosed extraction module can then dispense all of the captured cells within the collection chamber 422 into a separate container.

In another implementation, the extraction module 420 can be configured to have the collection chamber 422, but not the narrow entrance 424.

In one implementation, the chamber 422 and the tunnel 202*a* are fluidly accessed from the outside to deliver liquid and establish a fluid connection with a micro-well that contains a cell. This can be achieved by drilling a hole into the extraction module 410 or 420. In another implementation, the extraction module 420 can be fabricated to have a connection from the outside to the chamber 422. This can be achieved by using PDMS as the material for the extraction module and placing a tube into the PDMS during the fabrication process before the PDMS cures. Once the curing is completed, the PDMS will have solidified around the tube resulting in a connection to the chamber 422 from the outside. Similarly, the extraction module 410 can be fabricated to have the entrance of the tunnel 202*a* but not the longer, horizontal portion of the tunnel that established connection to the outside. The entrance of the tunnel can then be fluidly accessed from the outside by puncturing the extraction module with a needle or drilling a hole into the extraction module and inserting a tube into the hole.

Figure 4C:
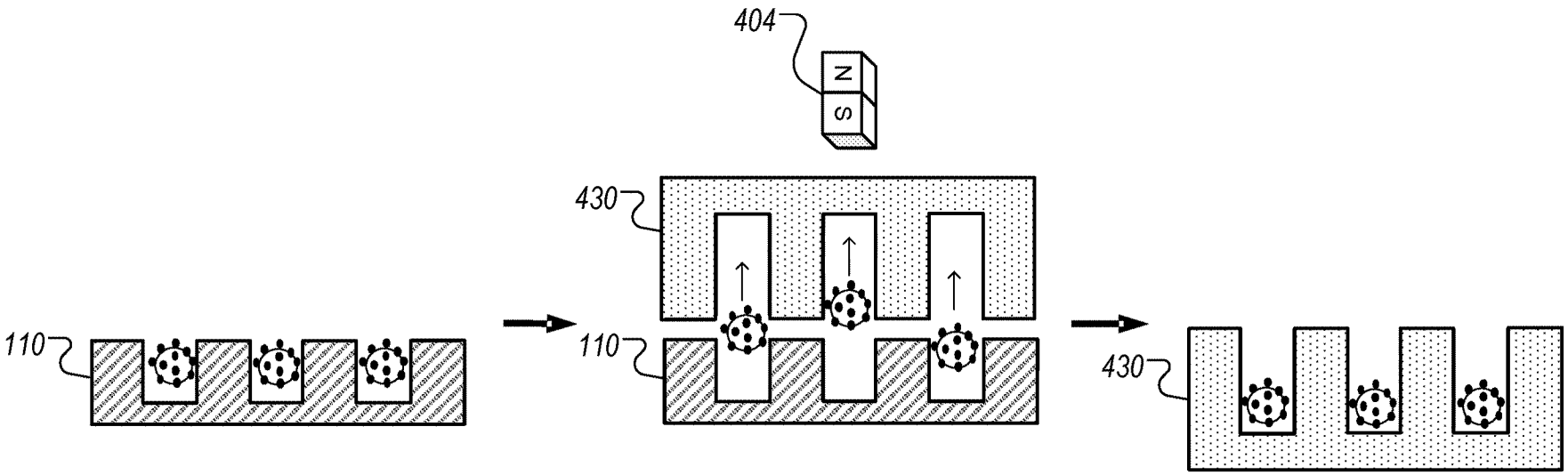
FIG. 4C is a cross-sectional diagram that illustrates an example of a transfer operation of target entities between two micro-well chips.

FIG. 4C is a cross-sectional diagram that illustrates an example of a transfer operation of target entities between two micro-well chips. In the example, target entities captured in the micro-wells of the micro-well chip 110 are transferred to micro-wells of a micro-well chip 430. During a transfer operation, micro-wells of the micro-well chip 430 are aligned with the micro-wells of the micro-well chip 110 that include captured target entities. An upward magnetic force is applied using the magnet 404 to transfer the captured target entities from the micro-wells of the micro-well chip 110 to the micro-wells of the micro-well chip 430. After the transfer operation has been completed, the micro-well chip 430 can be turned so that the magnetic force is no longer required to counteract the gravitational force experienced by the target entities.

In various other configurations, the transfer operation can be performed in other directions. For example, the micro-well chips 110 and 430 can be placed on the side to transfer, e.g., horizontally transfer, the captured target entities between the micro-wells. In another example, the micro-wells chips 110 and 430 can be placed such that the micro-well chip 110 is placed on top of the micro-well chip 430 such that a gravitational force can be used to transfer the target entities from the micro-wells of the micro-well chip 110 to the micro-wells of the micro-well chip 430.

In some implementations, the transfer operation can be conducted after immersing the micro-wells of micro-well chips 110 and 430 in liquid to, for example, provide a fluid interface for transfer, hydrate the target entities, among other purposes. In some implementations, the micro-well chips 110 and 430 can have micro-wells of different well depths. Alternatively, in other implementations, the micro-well chips 110 and 430 can have micro-wells that have the same well depth.

FIG. 5 illustrates an example of a single cell extraction technique. As depicted, a micropipette 510 can have an attached magnetic ring 520 used to extract a single cell 202*a* from the micro-well of the micro-well chip 110. The magnetic ring 520 can be placed at a sufficient distance from the tip of the micropipette 510 such that an attractive force is applied to the single cell 202*a* only once it has entered into the tip of the micropipette 510. The attractive force allows the single cell 202*a* to migrate up the micropipette towards the magnetic ring 520 and remains in the vicinity of the magnetic ring 520 in a controlled manner without traveling too far up the micropipette 510. In some instances, the micropipette 510 can be pre-filled with fluid to assist in the migration of the single cell 202*a* up the tip of the micropipette 510.

In some instances, the micropipette 510 can be configured to apply a suction force to facilitate the motion of the single cell 202*a* into the tip of the micropipette 510. In such instances, the suction force is initially used to assist the single cell 202*a* to enter the tip of the micropipette 510, and then migrate up the micropipette 510 based on the attractive force applied by the magnetic ring 520. The suction force can be controlled manually or automatically with the use of a computer-controlled robotic manipulator.

As described herein with respect to the magnet 130, the magnitude of the attractive force applied by the magnetic ring 520 can be modulated (e.g., moving the location of the magnetic ring 520 along a vertical location on the pipette 510, adjusting the current applied to a magnetic ring 520 that is an electromagnet) to control the migration of the single cell 202*a* up the tip of the micropipette 510. In some instances, the magnitude of the attractive force can be set to a particular value such that single cell 202*a* remains within a vicinity of the magnetic ring 520 after reaching a certain distance from the magnetic ring 520. For example, the magnitude of the magnetic force applied by the magnetic ring 520 can configured such that the cell 202*a* is stuck to the side of the micropipette 510 in the presence of a liquid flow out of the tip of the micropipette 510. In such instances, the micropipette 510 can then be used to transport the extracted cell to a precise location by using an outward hydraulic force from the micropipette 510 of a greater magnitude than the attractive force applied by the magnetic ring 520.

In one implementation, the magnetic ring can be an electromagnet whose strength could be adjusted or switched on and off to hold magnetized entities inside the tip or help ejecting them from the tip.

In one implementation, the magnetic ring is replaced with one or multiple magnets with cubic or rectangular shapes that are placed on one or multiple sides of the micropipette at a specific distance from the tip. The magnetic fields strength can be localized so as to prevent perturbation of other cells.

In a different implementation for cell extraction, the micro-well chip is accessed directly by conventional micropipettes that have tips that are small enough to enter into the micro-wells. The micropipettes can be connected to computer-controlled translation stages and fluidic flow control modules to fluidly extract the cells. Such implementations can be particularly useful for applications wherein the micro-well chip, after capturing of the cells only contains liquid in its micro-wells but not on its entire surface. This implementation can also be useful for applications that involve delivering a specific chemical or fluid into an individual micro-well without cross-contamination of other micro-wells. In this implementation, a magnetic force provided from below can hold the cell in place while a wash step is performed by injection using the pipette.

In one implementation, the pipette that is used has a tip that is larger than the entrance diameter of a micro-well. This implementation can be particularly useful when the micro-well chip is placed in a fluid in such a manner that the same fluid contacts most of the micro-wells. The fluidic suction created by a pump that is connected to the pipette can then be configured to be sufficient to extract the contents of a micro-well without perturbing the contents of other micro-wells. In one instance, the fluidic pressure and the spacing between the micro-wells can be configured to be large enough to prevent such perturbation. Alternatively, the spacing and the fluidic suction pressure can be controlled to cause extraction from a number of neighboring micro-wells without perturbing others.

In one implementation, a pump or syringe is configured to create a droplet of liquid extend from the tip of a pipette without completely detaching from the tip of the pipette. This droplet can then be used to form a fluid connection between the pipette and the liquid inside a micro-well. This fluid connection can then enable 'sucking' the cell out of the micro-well by means of a pump or a syringe that is connected to the pipette through a tube. This implementation can be particularly useful for applications where the micro-well chip is not placed in fluid in its entirety but contains liquid in its micro-wells.

In one implementation, the micro-well chip is accessed by micropipettes that are bent so as to prevent obstruction of microscopic viewing of the micro-well chip from above.

In one implementation, the magnetic field applied from underneath the micro-well chip is adjusted, instead of being completely turned off, to a level that will permit extraction of a magnetized entity using pipetting.

Figure 6:
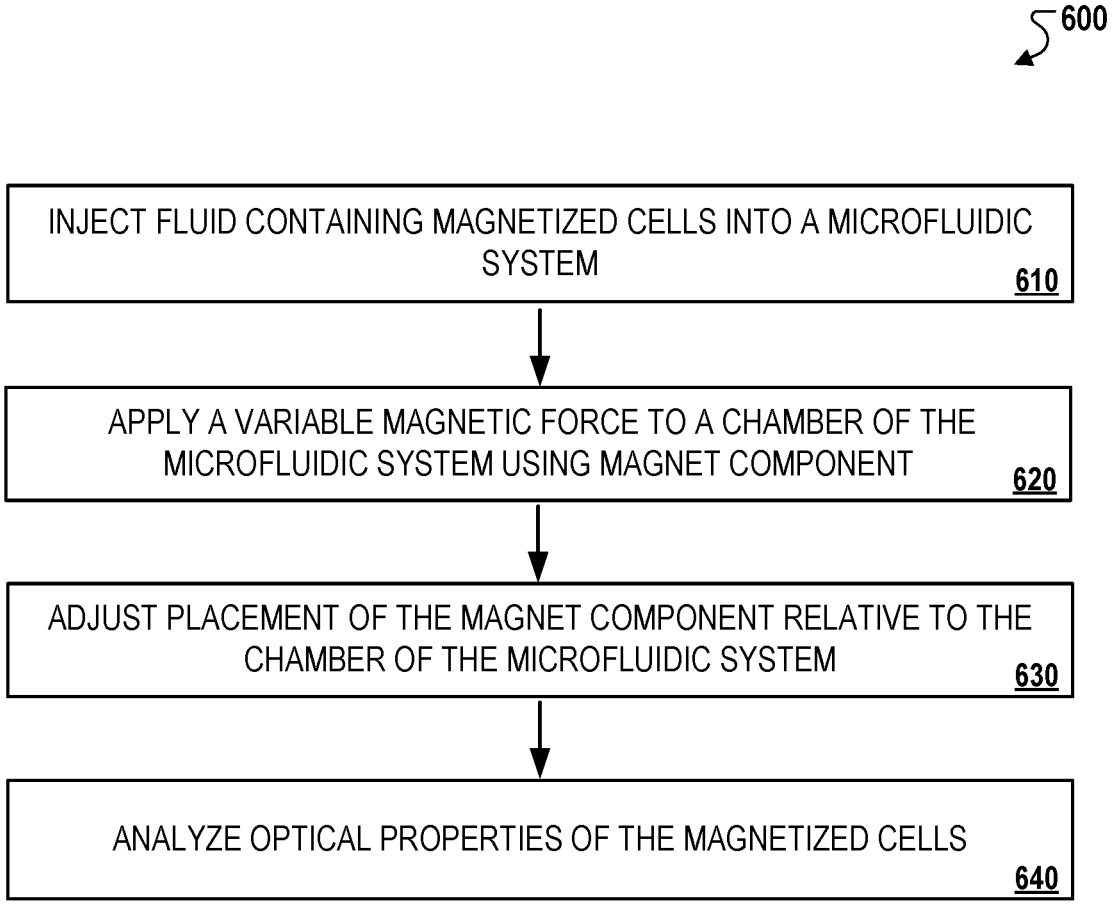
FIG. 6 is a flow chart for an example of a process for capturing cells using a cell analysis system described herein.

FIG. 6 is a flow chart that illustrates an example of a process 600 for capturing cells using a cell analysis system as described herein. Briefly, the process 600 includes injecting a fluid containing magnetized cells into a microfluidic system (610), applying a variable magnetic force to a chamber of the microfluidic system using a magnet component (620), adjusting placement of the magnet component relative to the chamber of the microfluidic system (630), and analyzing optical properties of the magnetized cells (640).

In more detail, the process 600 can include injecting a fluid containing magnetized cells into a microfluidic system (610). For instance, the sample fluid including target cells 202*a* can be injected into the microfluidic chamber of the micro-well chip 110 using the fluid control device 120.

The process 600 can include applying a variable magnetic force to a chamber of the microfluidic system using a magnet component (620). For instance, the magnet 130 can be used to generate the attractive force 212 beneath the micro-well chip 110 such that the target cells 202*a* are captured within the micro-wells on the surface of the micro-well chip 110. In some instances, the magnitude of the attractive force 212 can be modulated to increase or decrease the force applied on the target cells 202*a*.

The process 600 can include adjusting placement of the magnet component relative to the chamber of the microfluidic system (630). For instance, the magnet 130 can be moved along the x-axis and the y-axis of the surface of the micro-well chip 110 such that different portions of the micro-well chip 110 are exposed to the attractive force 212. As described previously, the adjustment can be made in certain patterns (e.g., circular, zigzag, raster, or sigmoidal) to improve the capture efficiency of the micro-wells.

The process 600 can include analyzing optical properties of the magnetized cells (640). For instance, the analyzer device 140 can be used to assess or analyze the target cells 202*a* that are captured in the micro-wells of the micro-well chip 110. In some instances, the analyzer device 140 can be a microscope that uses various types of imaging modalities to collect images of the captured cells as described herein.

EXAMPLES

The invention is further described in the following examples, which do not limit the scope of the invention described in the claims.

Example 1—Magnetic Bead Capture Device

In one example, the micro-well chip is a silicon wafer with an array of micro-wells that are eight micrometers in diameter and approximately 10 micrometers in depth that were formed using an etching technique. In this example, no cells were tested, but 2.8 micrometer streptavidin-coated magnetic beads conjugated with biotinylated-FITC for fluorescence measurements were tested as a proof-of-concept. A PDMS spacer was placed around the micro-well chip so as to form a cuvette (i.e., without using a closed fluidic chamber) that can hold approximately 200 microliters of fluid.

During a preliminary experiment, a 200-microliter phosphate buffered saline-tween (PBST) buffer containing a 50 microliter bead suspension (approximately 350,000 magnetic beads) was initially placed on the micro-well chip as a droplet using a micropipette. A magnet was then swept underneath the micro-well chip to capture the magnetic beads into the 8 micrometer micro-wells. The micro-well chip was then placed underneath a bright field microscope and a fluorescent microscope was used to analyze the capture efficiency of the magnetic beads on the micro-well chip.

A first bright field image and a fluorescent image of the same array of micro-wells were captured prior to the magnet sweep and utilized as a control measurement for cell capture within the micro-wells. After performing a magnet sweep, a second bright field image and fluorescent image of the array of micro-wells were captured to determine the impact of the attractive force on the capture efficiency by the micro-wells. Comparisons of the captured images indicate that the magnet sweep improved the capture efficiency of the micro-wells (indicated by the increased fluorescence detected within the array of micro-wells), which suggests that a greater number of magnetic beads were captured by the micro-wells.

Example 2—Capture of KB Cells in Silicon Micro-Wells

In this example, the micro-well chip is a silicon wafer with an array of micro-wells that are 30 micrometers in diameter and approximately 40 micrometers in depth with 200-micrometer center-to-center spacing that was formed using photolithography and a deep reactive ion etching technique. The micro-well chip surface was blocked with a PBST buffer that contains BSA (bovine serum albumin) to prevent or minimize sticking of cells onto the chip surface or the micro-wells.

A feasibility experiment was conducted to verify the capability of directing magnetized cells into micro-wells as well as extracting them using a pipette. A PDMS spacer/frame was placed on the micro-well chip in a manner that surrounds the area that contained the micro-wells. The PDMS frame served for the purpose of a "cuvette" that was capable of maintaining a maximum fluid volume of 200 microliters. A 100-microliter sample fluid with approximately 1000 KB cells (cultured tumor cells) that were previously labeled with both anti-folate-receptor antibody conjugated magnetic beads, and FITC-conjugated folate were introduced into the cuvette. (The beads were 1-micrometer streptavidin coated superparamagnetic beads that were conjugated with biotinylated antibodies against folate receptor).

A magnet was then placed underneath the microfluidic chamber and swept across from one side of the micro-well chip to the opposite side of the micro-well chip for about 10 seconds to apply an attractive force across the micro-well chip during the sweep of the magnet to capture the cultured tumor cells into the micro-wells of the micro-well chip. The micro-well chip was then imaged using both bright field as well as fluorescent microscopy for analysis. The magnet was swept from side to side, but can also be moved in a circular or sinusoidal pattern.

Figure 7A:
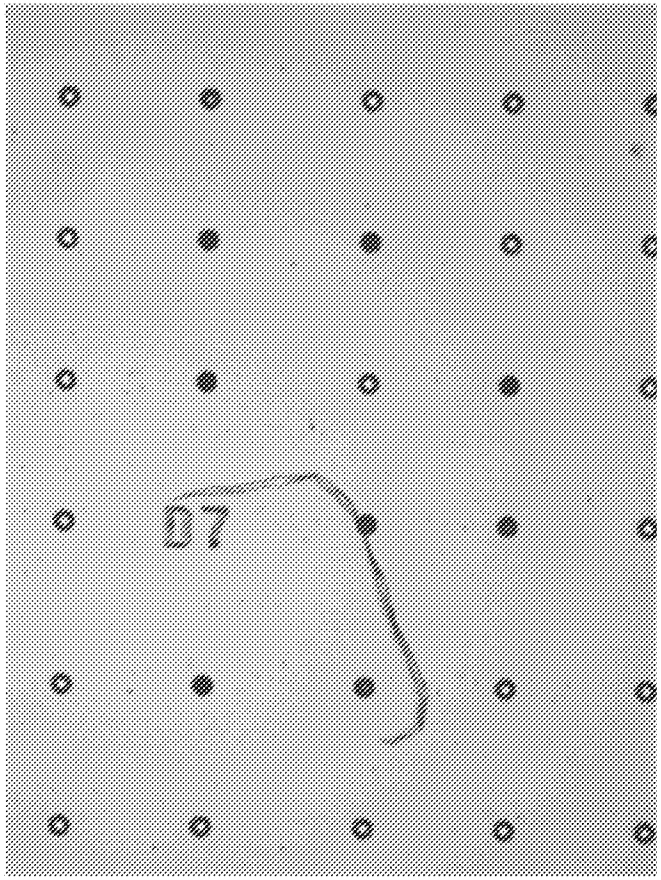
FIG. 7A (light microscope) and 7B (fluorescence microscope) are representations of photos that show results of experiments conducted on a cell capture device that includes a silicon substrate with micro-fabricated micro-wells.
Figure 7B:
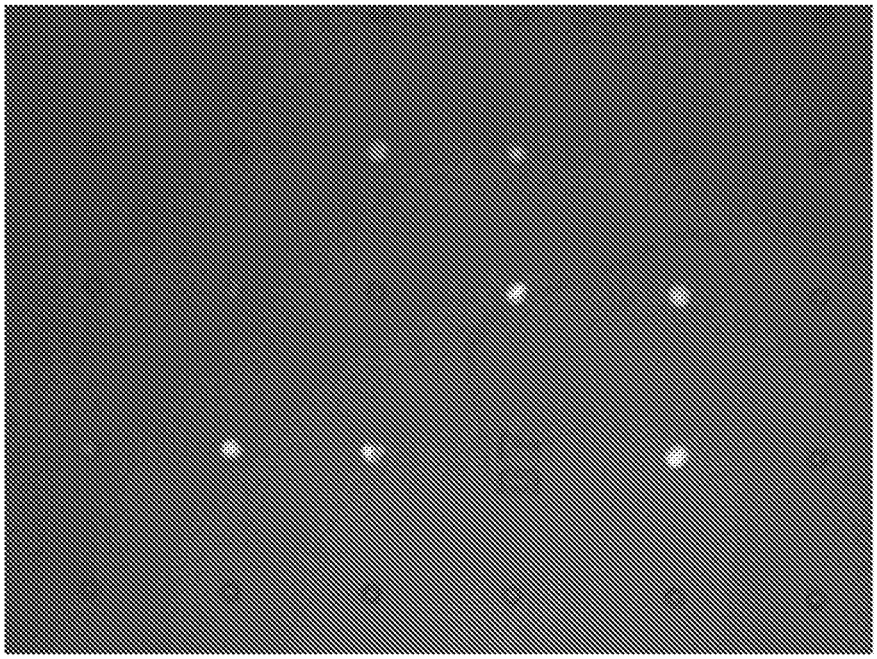

FIGS. 7A and 7B are representations of photos that show results of this feasibility experiment. FIG. 7A shows the bright field image of a part of the micro-well chip that has some micro-wells that have cells as well as some micro-wells that are empty. The micro-wells that have cells in them appear darker due to scattering and absorption of the illuminating light, whereas the empty micro-wells have a bright spot in their center due to the reflection of the illuminating light.

In the experiment, the presence of cells was verified by fluorescence microscopy (FIG. 7B.) FIG. 7B shows clearly that the system was able to direct the cells into micro-wells as well as clearing magnetized cells from the surface (area between the micro-wells). In fact, one can notice in FIG. 7B that a piece of dirt, which is unlikely to be magnetic in nature, remains on the surface, because it was not moved by a magnetic field. It is also possible to see in FIG. 7B that some micro-wells are brighter than others. This is because in this particular experiment, the size of the micro-wells were larger than that of the targeted cells (KB cells are sized between 10-15 micrometers), which caused some micro-wells to retain more cells than others. This experiment confirms that micro-wells with sufficient size can retain multiple cells and cell clusters, and suggests that smaller micro-wells may need to be used to capture single cells.

In some implementations, this optical effect illustrated in FIGS. 7A-B can be used to quickly recognize empty micro-wells as well as those that accommodate cells. The apparent difference between bright and dark micro-wells in the photograph can reduce the need to use high magnification or high-resolution microscopy to identify cell capture. This is because the distinction can often be detected at lower magnifications (e.g., 20×, 10×, 5× optical zooms, or lower magnifications).

In some implementations, one or more computer algorithms are used to recognize the presence of one or more target entities in micro-wells, determine locations of identified target entities, and assign specific coordinates for each micro-well of a micro-well chip. In these implementations, location and coordinate information is used to extract the contents of micro-wells (e.g., captured target entities) in a substantially automatic computer-implemented manner (e.g., without human intervention). For example, an actuating device can be used to move a pipette to a coordinate location of a particular micro-well and then operate the pipette to extract the contents of the particular micro-well without the need to use microscopy to visualize and/or identify the location of the particular micro-well. In addition, assigned coordinate locations of micro-wells can also be used to standardize extraction techniques such that the contents of a particular micro-well chip can examined in different experimental laboratories with the use of an assigned coordinate location.

Figure 8:
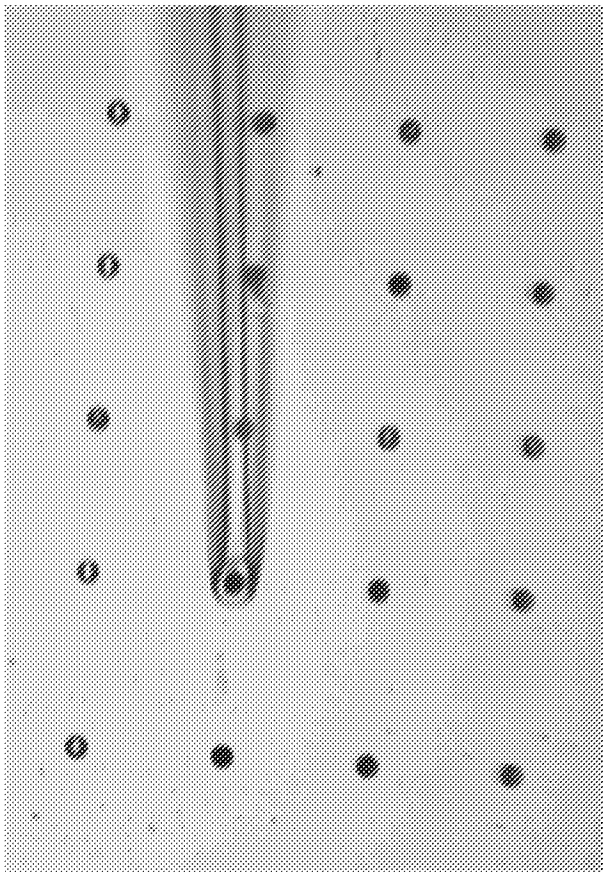
FIG. 8 is a representation of a photo that shows the results of an experiment in which cells located in a micro-well chip are extracted by means of a pipette.

FIG. 8 is a representation of a photo that shows results of an experiment where the cells located in an area of the chip depicted in FIGS. 7A-B are extracted by using a micropipette. During this experiment, the surface of the micro-well chip was covered with fluid sample that was retained by the PDMS frame as discussed above. A micropipette with a bent tip was used to enable microscopic visualization of the procedure from above. The pipette tip was attached to a syringe that was affixed to a translation stage whose motion could be precisely controlled.

FIG. 8 shows that the transparent bent pipette is aligned with a micro-well. The tip of the pipette is around 50 to 60 micrometers in diameter. In the experiment, the contents of the micro-well that the pipette is aligned with in FIG. 8 was extracted by applying a suction through the micropipette. Then, the contents of the two micro-wells to the immediate left of this micro-well were sequentially extracted. FIG. 8 shows that these three micro-wells are not empty. Note that the micro-wells that were not intended for extraction have not been perturbed significantly and their contents are still in the respective micro-wells. In the figure, micro-wells that appear to have a dark color were identified as micro-wells that captured cells, whereas micro-wells that appear to be clear represent empty micro-wells.

Example 3—Comparison of Cell Extraction Techniques

Figure 9A:
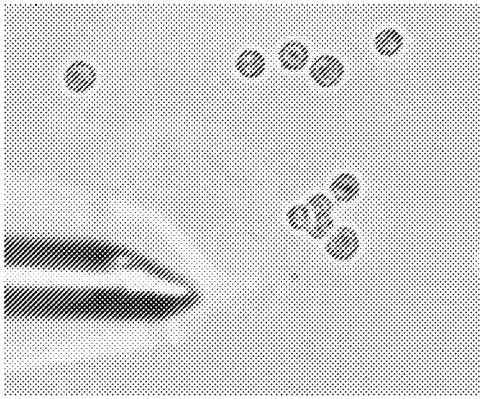
FIGS. 9A-D are representations of photos that show results of an experiment comparing cell extraction with and without the use of micro-wells.
Figure 9B:
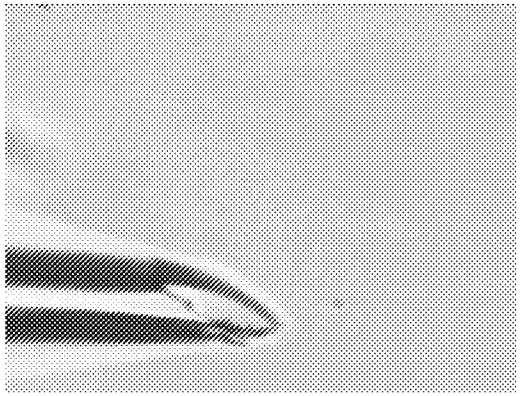
Figure 9C:
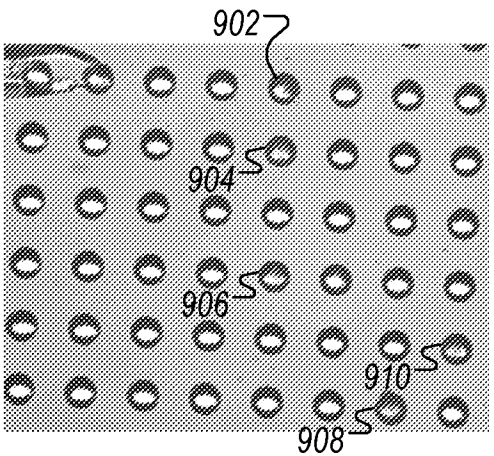
Figure 9D:
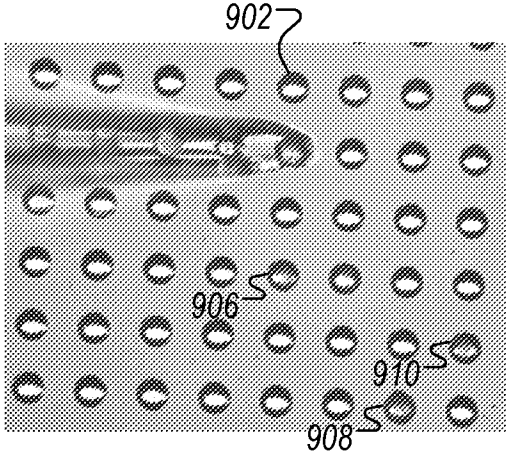

FIGS. 9A-D are representations of photos that show results of an experiment comparing cell extraction with and without the use of micro-wells. FIGS. 9A and 9B illustrate bright-field images of an extraction procedure for a single cell on a plain surface (e.g., without micro-wells), and FIGS. 9C and 9D illustrate bright-field images of an extraction procedure for a single cell that has been captured in a micro-well. The extraction procedures were conducted using a micropipette to apply a suction force to extract a cell of interest.

FIGS. 9A and 9C depict images that were captured prior to the start of an extraction procedure (e.g., prior to applying a suction force to verify that a cell was present near the tip of a micropipette) and FIGS. 9B and 9E depict images that were captured after the extraction procedure was completed (e.g., after applying a suction force to identify the impact of extracting a cell on an environment nearby the extracted cell).

Results depicted in FIGS. 9A and 9B indicate that, during the first extraction procedure, the suction force applied by the micropipette eventually captured a cell of interest as well as nearby cells within the field of view of the microscope. This indicates that this type of extraction procedure would make it challenging to selectively target and capture a particular cell without also capturing nearby cells. In contrast, the results depicted in FIGS. 9C and 9D illustrate that, when a captured cell of interest is extracted from a micro-well, cells that are located in nearby micro-wells are not captured and remain in their locations. For example, FIG. 9C indicates that a cell is initially present in micro-well 902 prior the application of a suction force. The cell captured in the micro-well 902 was eventually extracted during the extraction operation, indicated the empty micro-well 902 in FIG. 9D. The results depicted in FIG. 9D further indicate that the presence of cells in micro-wells 906, 908, 910 were not captured as a result of applying the suction force to extract the cell captured in micro-well 902.

Example 4—Fluorescence-Guided Cell Extraction

An experiment was performed to verify if a single cell could be extracted from a micro-well chip without perturbing cells that were captured in nearby micro-wells. In this experiment, the chip included micro-wells that captured different kinds of fluorescently tagged cells (magnetized KB cells, and magnetized MCF-7 cells). The fluorescence signals produced was used as an indicator of a cell being captured in a micro-well, and visual confirmation that a cell had been extracted from the micro-well after applying a suction force using a micropipette. The KB cells were labeled with FITC-tagged magnetic beads baring anti-folate receptor antibodies that emit a green fluorescence signal. The MCF-7 cells were labeled with PE-tagged magnetic beads baring anti-EpCAM antibodies that emit a red fluorescence signal.

Fluorescent images were captured during an extraction procedure for a single KB cell (green) to determine if the extraction affected cells captured in nearby micro-wells. A first set of images were captured prior to extraction to use a green fluorescence signal produced by the KB cell to verify that it was captured in a micro-well. These images were also used to verify that a MCF-7 cell (red) was not captured even though it was in a nearby micro-well. A second set of images were captured during the extraction procedure to identify movement of the KB cell after being exposed to a suction force applied by a micropipette placed above the micro-well where the KB cell was captured. A third set of images were captured after completing the extraction procedure to characterize the impacts of the extraction procedure on nearby cells such as the MCF-7 cell.

Results from the collected images indicated that a suction force applied by a micropipette caused the KB cell to travel inside a tip of the micropipette after a suction force was applied above a micro-well where the cell was captured. Once the extraction operation was completed, results indicated that the MCF-7 cell was still present in its location (determined based on comparing the presence of a fluorescence signal in images collected prior to and after the extraction procedure). These results illustrate the benefit of using a micro-well chip to separate rare cell populations into individual micro-wells, where the number of cells in a fluid sample is significantly less than the number of micro-wells on the surface of the micro-well chip.

Example 5—High-Throughput Analysis of Cell Populations

An experiment was performed to determine the impact of having multiple cell populations within a single substrate on the capturing ability of micro-wells on the surface of a micro-well chip. The substrate included two kinds of fluorescently tagged cells (magnetized KB cells, and magnetized MCF-7 cells). The KB cells were labeled with FITC-tagged magnetic beads baring anti-folate receptor antibodies that emit a green fluorescence signal. The MCF-7 cells were labeled with PE-tagged magnetic beads baring anti-EpCAM antibodies that emit a red fluorescence signal.

During the experiment, the micro-well chip was placed in a closed fluidic chamber and the mixture was initially distributed over the micro-wells by a laminar fluid flow. The flow was then stopped and a magnetic sweep was performed to attract the magnetized cell populations towards the surface of the micro-well chip to induce cell capture within micro-wells. Fluorescent images of the surface of the micro-well chip were then captured to identify cell capture based on the presence of fluorescent signals within the micro-wells. To determine whether cell capture was localized to a particular regions of the micro-well chip, various fields of views were captured and stitched together to reconstruct a high field-of-view image that collectively represented a large area of the surface of the micro-well chip.

Results indicated that over 1000 cells were captured in the micro-wells of the micro-well chip. Results also indicated that both types of cells (e.g., KB cells and MCF-7 cells) were captured within the micro-wells, indicating that the presence of different cell types did not cause preferential cell capture within the micro-wells.

Example 6—Multiple Target Molecule Detection

In another example, a micro-well chip can be used to detect and analyze multiple target entities such as different types of viruses or molecules within a single microfluidic chamber. In this example, the micro-well chip 110 can be constructed to have a micro-well arrangement pattern that includes a set of micro-well entrance sizes on the surface of the micro-well chip 110 corresponding to a set of individual magnetic beads that are each associated with a different target entity.

For instance, each group of magnetic beads, with each group having a different size, can initially be functionalized to recognize and bind specifically to (e.g., with the use of an antibody) one type of target molecule. The magnetic beads can then be exposed to the fluid sample containing different types of target molecules. After the magnetic beads have been bound to the respective target molecules, the fluid sample can be introduced into the microfluidic chamber of the micro-well chip 110 and the different micro-well entrance sizes corresponding to the various magnetic beads can be used to separate the capture of target molecules by magnetic bead size (e.g., smaller magnetic beads with corresponding target entities being captured upstream). The micro-well chip 110 can then be used with single color fluorescence detection to obtain readouts using single-color fluorescent microscopes or inexpensive plate readers. In this implementation, the types of target entities that can be detected include DNA, RNA, proteins, antibodies, enzymes, viruses, extracellular vesicles, exosomes, nucleosomes, small molecules and peptides.

Example 7—Disaggregation of Magnetized Cells Using a Ring Magnet

Figure 10A:
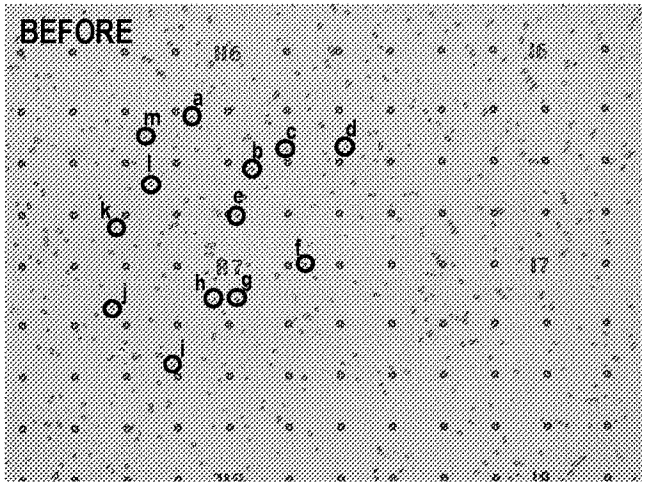
FIGS. 10A-C are representations of photos that show results of an experiment that examined the use of a ring-shaped magnet to disaggregate and/or separate clusters of target entities on the surface of a micro-well chip.
Figure 10B:
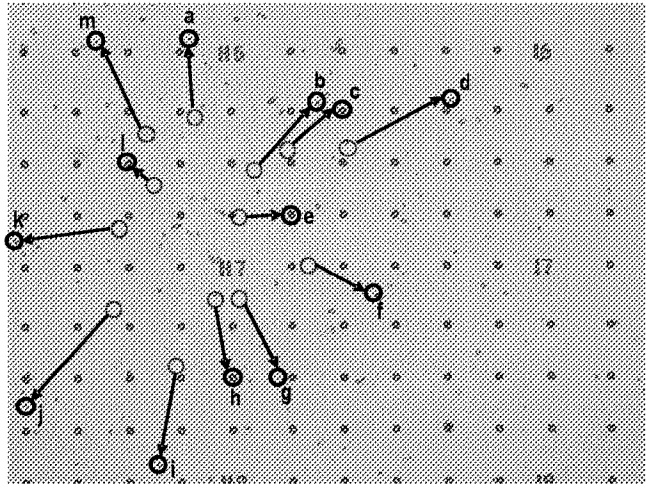
Figure 10C:
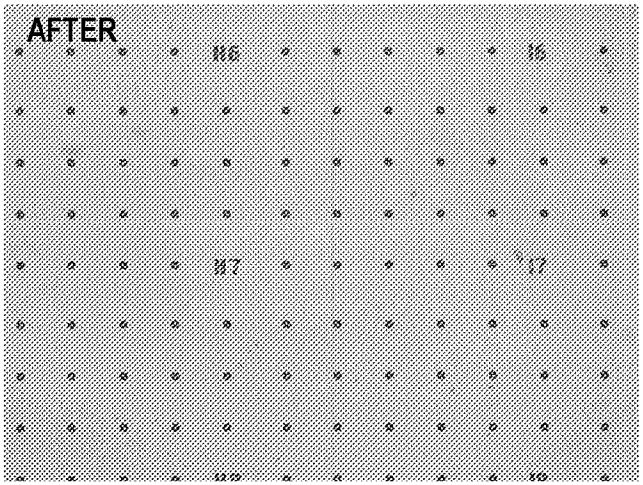

FIGS. 10A-C are representations of photos that show results of an experiment that examined the use of a ring-shaped magnet to disaggregate and/or separate clusters of target entities on the surface of a micro-well chip. FIGS. 10A-C illustrate bright-field images of a disaggregation procedure where cells on the surface of a micro-well chip were subjected to an outward magnetic force using a ring-shaped magnet placed underneath the micro-well chip.

FIG. 10A depicts an image of MCF-7 cells that were tagged with EpCAM-barring superparamagnetic beads (labelled as "a-m" in the figure) and were placed on the surface of the micro-well chip. An outward magnetic force was applied using the ring-shaped magnet, which caused a dispersing effect on the cells as depicted in FIG. 10B. As shown, cells moved outward away from a central point due to the outward magnetic force provided by the ring-shaped magnet. FIG. 10C depicts an image after the disaggregation procedure was completed. AS shown, cells on the surface of the micro-well chip were removed entirely from the field of view of the microscope. These results indicate that the application of an outward magnetic force using a ring-shaped magnet can be used to prevent unintentional aggregation or clustering of target entities.

OTHER IMPLEMENTATIONS

A number of implementations have been described. Nevertheless, it will be understood that various modifications can be made without departing from the spirit and scope of the invention. In addition, the logic flows depicted in the figures do not require the particular order shown, or sequential order, to achieve desirable results. In addition, other steps can be provided, or steps can be eliminated, from the described flows, and other components can be added to, or removed from, the described systems. Accordingly, other implementations are within the scope of the following claims.

What is claimed is:

1. A microfluidic system for capturing target entities that are, or are made to be magnetic, the system comprising:

a body comprising a chamber having an inlet, an outlet, and configured to contain a micro-well array device, wherein the micro-well array device comprises a substrate including a surface comprising a plurality of micro-wells arranged in one or more arrays on the surface;

a first array of micro-wells is arranged at a first location on the surface;

a second array of micro-wells, and subsequent arrays of micro-wells if present, are arranged sequentially on the surface at second and subsequent locations, wherein when a liquid sample is added onto the substrate and caused to flow, the liquid sample will flow across the first array first and then flow across the second and any subsequent arrays in sequential order;

micro-wells in the first array each have a size that permits entry of only one target entity into the micro-well and wherein each micro-well in the first array has approximately the same size;

micro-wells in the second array, and in subsequent arrays if present, each have a size that is at least ten percent larger than the size of the micro-wells in the previously adjacent array and wherein each micro-well in the second array has approximately the same size, and wherein in a given subsequent array if present, each micro-well in a given subsequent array has approximately the same size, and the plurality of micro-wells all have a size sufficient such that after target entities enter the micro-wells, at least one target entity remains within a micro-well when fluid flows across the surface or when a magnetic force is applied to the target entities in the micro-wells or both fluid flows and a magnetic force is applied; and a magnet component adjustably arranged adjacent to the surface, wherein the magnet component is arranged and configured to generate a magnetic force sufficient to move target entities sized to fit into the micro-wells in the first array along the surface and into the micro-wells in the first array and to move larger target entities along the surface and into the second array and into any subsequent arrays, and sufficient such that after target entities enter the micro-wells, at least one target entity remains within a micro-well when fluid flows across the surface or when a magnetic force is applied to the target entities, or both fluid flows and the magnetic force is applied.

2. The microfluidic system of claim 1, wherein the microfluidic system further comprises a detector configured to analyze optical properties of the target entities.

3. The microfluidic system of claim 1, wherein the magnet component is configured to be moved along two axes relative to the surface.

4. The microfluidic system of claim 1, wherein a portion of the body above the chamber is detachable from the body of the microfluidic system.

5. The microfluidic system of claim 1, wherein the micro-well array device is an integral part of the body and the surface of the micro-well array device forms one wall of the chamber.

6. The microfluidic system of claim 1, further comprising:

a pump for flowing the fluid from the inlet of the chamber to the outlet of the chamber at a flow rate sufficient to permit target entities to reach the micro-well arrays.

7. The microfluidic system of claim 1, further comprising:

a target entity extraction module configured to extract target entities from at least one of the plurality of micro-wells; and a second magnet component adjustably arranged relative to the target entity extraction module opposite the plurality of micro-wells, wherein the second magnet component is configured to generate a variable magnetic force sufficient to attract a target entity that is, or is made to be, magnetic from a micro-well into an entrance channel of the target entity extraction module.

8. The microfluidic system of claim 7, wherein:

the target entity extraction module comprises a micropipette, and the second magnet component comprises a magnetic ring placed on a tip of the micropipette.

9. The microfluidic system of claim 1, wherein the surface comprises:

a base layer; and a micro-well layer arranged on top of and contacting the base layer, wherein the micro-well layer comprises a plurality of through holes, wherein the plurality of through holes form the plurality of micro-wells.

10. The microfluidic system of claim 9, wherein the base layer is functionalized with one or more binding moieties to enhance binding of the target entities to the base layer.

11. The microfluidic system of claim 1, wherein:

micro-wells in the second array each have a size that permits entry of a second target entity into the micro-well, wherein the second target entities are larger than the first target entities; and wherein micro-wells in the first array each have a size that does not permit entry of the second target entity into the micro-well.

12. The microfluidic system of claim 1, wherein the size of the micro-well is any one or more of diameter, cross-sectional area, depth, shape, and total volume.

13. The microfluidic system of claim 1, wherein the size of the micro-wells that is varied between arrays is a diameter, volume, or cross-sectional area, while a depth of the plurality of micro-wells is approximately the same in all arrays.

14. The microfluidic system of claim 1, further comprising a set of magnetic beads comprising on their surfaces one or more binding moieties that specifically bind to a molecule on the surface of the target entities.

15. A method of capturing target entities, the method comprising:

adding a fluid sample containing magnetic target entities onto a surface of the microfluidic system claim 1;

applying, using a magnet component adjustably arranged underneath the surface, a variable magnetic force to the chamber; and adjusting the position of the magnet component relative to the surface such that the applied variable magnetic force attracts the target entities into the first and/or second array of micro-wells.

16. The method of claim 15, further comprising analyzing, using a detector component, a property of the target entities.

17. The method of claim 16, wherein the property to be analyzed comprises quantity, size, sequence and/or conformation of molecules, DNA, RNA, proteins, small molecules, and enzymes contained inside the target entities, or molecular markers contained on surfaces of target entities, or molecules secreted from target entities.

18. The method of claim 15, further comprising:

after adjusting the position of the magnet component relative to the surface, detaching a lid of the body of the microfluidic system; and extracting a target entity from at least one of the plurality of micro-wells.

19. The method of claim 18, wherein extracting the target entity from at least one of the plurality of micro-wells comprises transporting the extracted target entity to a container outside the microfluidic system.

20. The method of claim 16, wherein the analyzing comprises detecting fluorescence emitted by the target entities.

21. The method of claim 15, wherein adjusting the position of the magnet component comprises moving the magnet component along at least one axis relative to the surface.

22. The method of claim 15, further comprising:

after adjusting the placement of the magnet component relative to the surface, providing a turbulent flow into the microfluidic device; and extracting a target entity from at least one of the plurality of micro-wells.

23. The method of claim 15, wherein adjusting the placement of the magnet component relative to the surface comprises moving the magnet component in a pattern that causes the target entities to follow the pattern along the surface.

24. The method of claim 15, wherein adding the fluid sample containing magnetic target entities into the chamber comprises flowing the fluid sample from the inlet to the outlet over the surface comprising the plurality of micro-wells.

25. The method of claim 15, wherein adding the fluid sample containing magnetic target entities into the chamber comprises dispensing the fluid sample onto the surface of the chamber comprising the plurality of micro-wells.

26. The method of claim 15, wherein the variable magnetic force is applied to the chamber while the fluid sample is being placed into the chamber of the microfluidic chamber.

* * * * *